US010030656B2

(12) United States Patent
Valkenberg

(10) Patent No.: US 10,030,656 B2
(45) Date of Patent: Jul. 24, 2018

(54) VARIABLE DISPLACEMENT VANE PUMP WITH INTEGRATED FAIL SAFE FUNCTION

(71) Applicant: Stackpole International Engineered Products, Ltd., Mississauga, Ontario (CA)

(72) Inventor: Ralph Valkenberg, Stolberg (DE)

(73) Assignee: Stackpole International Engineered Products, Ltd., Mississauga, Ontario (CA)

( * ) Notice: Subject to any disclaimer, the term of this patent is extended or adjusted under 35 U.S.C. 154(b) by 260 days.

(21) Appl. No.: 14/983,654

(22) Filed: Dec. 30, 2015

(65) Prior Publication Data

US 2016/0186752 A1 Jun. 30, 2016

Related U.S. Application Data

(63) Continuation-in-part of application No. 14/588,049, filed on Dec. 31, 2014, now Pat. No. 9,534,519.

(51) Int. Cl.
*F01C 20/18* (2006.01)
*F04C 14/24* (2006.01)
(Continued)

(52) U.S. Cl.
CPC ..... *F04C 14/24* (2013.01); *F01M 1/02* (2013.01); *F04C 2/3441* (2013.01);
(Continued)

(58) Field of Classification Search
CPC .... F01M 1/02; F01M 1/16; F01M 2001/0238; F01M 2001/0246; F04C 14/226;
(Continued)

(56) References Cited

U.S. PATENT DOCUMENTS 4,510,962 A 4/1985 Mott
6,120,266 A 9/2000 Miyazawa
(Continued)

FOREIGN PATENT DOCUMENTS

CN 101517236 A 8/2009
CN 102844570 A 12/2012
(Continued)

OTHER PUBLICATIONS

Non-Final Office Action Japanese Patent Application No. 2016-534132 dated Jul. 11, 2017 with English translation.
(Continued)

*Primary Examiner* — Jesse Bogue
(74) *Attorney, Agent, or Firm* — Pillsbury Winthrop Shaw Pittman LLP

(57) ABSTRACT

A variable displacement vane pump has a pressure controlled valve moveable between first and at least second valve positions based on an output pressure of the pressurized lubricant delivered through the outlet. The pressure controlled valve provides an integrated fail safe function to the pump when an electrical valve fails. The pressure controlled valve is inactive in the first position for an output pressure below a threshold level, allowing an electrical valve (current, solenoid, pulse width modulation (PWM) valve) to selectively control pressure in the control chamber under normal operation of the pump. In fail safe regulation mode, the electrical valve function is disabled and the pressure controlled valve is active in its second position, controlling pressure in the control chamber. Channels and vents in the pump can be opened and closed based on selective movement of the valve when the outlet pressure is at or above a threshold level.

28 Claims, 13 Drawing Sheets

(51) Int. Cl.

| | |
|---|---|
| ***F04C 2/344*** | (2006.01) |
| ***F04C 14/18*** | (2006.01) |
| ***F04C 15/06*** | (2006.01) |
| ***F01M 1/02*** | (2006.01) |
| ***F04C 14/22*** | (2006.01) |
| ***F04C 14/26*** | (2006.01) |
| ***F04C 14/28*** | (2006.01) |

(52) U.S. Cl.
CPC ..... *F04C 2/3448* (2013.01); *F04C 14/18* (2013.01); *F04C 14/226* (2013.01); *F04C 14/26* (2013.01); *F04C 14/28* (2013.01); *F04C 15/064* (2013.01); *F01M 2001/0238* (2013.01); *F01M 2001/0246* (2013.01); *F04C 2240/811* (2013.01)

(58) Field of Classification Search
CPC ..... F04C 2/344; F04C 14/18; F04C 14/24; F04C 14/26
See application file for complete search history.

(56) References Cited

U.S. PATENT DOCUMENTS

| | | | | |
|---|---|---|---|---|
| 6,155,797 | A | 12/2000 | Kazuyoshi | |
| 6,481,458 | B2 | 11/2002 | Hirano et al. | |
| 8,047,822 | B2 | 11/2011 | Shulver et al. | |
| 8,057,201 | B2 | 11/2011 | Shulver et al. | |
| 8,444,395 | B2 | 5/2013 | Tanasuca et al. | |
| 8,720,849 | B2 | 5/2014 | Williamson | |
| 2005/0019175 | A1 | 1/2005 | Uchino et al. | |
| 2008/0069704 | A1 | 3/2008 | Armenio et al. | |
| 2008/0286118 | A1* | 11/2008 | Gu | F04C 18/0215 417/1 |
| 2010/0139611 | A1* | 6/2010 | Hunter | F04C 2/3442 123/196 R |
| 2011/0014078 | A1* | 1/2011 | Ono | F04C 2/086 418/166 |
| 2012/0148423 | A1* | 6/2012 | Wagner | F01M 1/16 417/311 |
| 2012/0183426 | A1 | 7/2012 | Maffeis | |
| 2012/0199411 | A1 | 8/2012 | Nonaka et al. | |
| 2012/0251342 | A1 | 10/2012 | Shulver et al. | |
| 2013/0039790 | A1 | 2/2013 | Cuneo | |
| 2013/0136641 | A1 | 5/2013 | Novi et al. | |
| 2014/0072456 | A1 | 3/2014 | Watanabe et al. | |
| 2014/0072458 | A1 | 3/2014 | Watanabe | |
| 2014/0219847 | A1 | 8/2014 | Watanabe | |
| 2015/0218983 | A1* | 8/2015 | Watanabe | F04C 2/3442 210/130 |
| 2016/0069346 | A1 | 3/2016 | Arnold | |
| 2016/0186752 | A1 | 6/2016 | Valkenberg | |

FOREIGN PATENT DOCUMENTS

| | | | |
|---|---|---|---|
| CN | 103671102 | A | 3/2014 |
| EP | 1 350 957 | | 10/2003 |
| JP | 4070391 | B2 | 1/2008 |
| JP | 2012-163031 | A | 8/2012 |
| JP | 2014-105623 | A | 6/2014 |
| KR | 10-2012-0090838 | A | 8/2012 |
| WO | WO 2008/037070 | | 4/2008 |
| WO | 2014/038302 | A1 | 3/2014 |
| WO | WO 2014/038302 | | 3/2014 |

OTHER PUBLICATIONS

International Search Report PCT/IB2015/060076 dated Mar. 30, 2016.
International Preliminary Report on Patentability PCT/IB2015/060076 dated Jul. 4, 2017.
Notification of Reasons for Refusal Korean Patent Application No. 10-2016-7017006 dated Jun. 7, 2017 with English translation.
Office Action dated Mar. 22, 2017 in Chinese Application 201580003326.2 and English translation thereof.
Korean Office Action dated Dec. 21, 2016 for Appln. No. 2016-7017006.
Extended European Search Report dated Jan. 10, 2017 for Appln. No. 15875359.0.
Manfred Arnold, U.S. Appl. No. 14/477,620, filed Sep. 4, 2014.
U.S. Notice of Allowance dated Oct. 11, 2016 for U.S. Appl. No. 14/588,049.

* cited by examiner

VARIABLE DISPLACEMENT VANE PUMP WITH INTEGRATED FAIL SAFE FUNCTION

CROSS REFERENCE TO RELATED APPLICATION

This application is a continuation-in-part of and claims priority to U.S. patent application Ser. No. 14/588,049, filed Dec. 31, 2014, which is hereby incorporated by reference in its entirety.

BACKGROUND

Field

The present disclosure is generally related to a variable displacement vane pump for providing pressurized lubricant to a system. More specifically, this disclosure relates to integrating a fail-safe function in the form of a pressure controlled valve into a pump that has an electrical valve.

Description of Related Art

Vane pumps are known for use for pumping fluids or lubricants, such as oil, to internal combustion engines. Some known systems may utilize a single control chamber for moving lubricant. U.S. Pat. Nos. 8,602,748 and 9,097,251 and U.S. Patent Application No. 2013/0136641 illustrate examples of passively controlled variable vane pump having one control chamber, each of which is hereby incorporated in their entirety. Other types of pumps are disclosed in U.S. Pat. Nos. 8,047,822, 8,057,201, and 8,444,395, which are also incorporated herein in their entirety.

SUMMARY

It is an aspect of this disclosure to provide a variable displacement vane pump for dispensing lubricant to a system. The pump is connected to a lubricant sump for holding lubricant. The pump includes: a housing, an inlet for inputting lubricant from a source into the housing, and an outlet for delivering pressurized lubricant to the system from the housing. The pump also includes a control slide displaceable within the housing between a first slide position and a second slide position to adjust displacement of the pump through the outlet, a resilient structure biasing the control slide towards the first slide position, a rotor with at least one vane mounted in the housing and configured for rotation within and relative to the control slide, the at least one vane configured for engagement with an inside surface of the control slide during rotation thereof, and a control chamber between the housing and the control slide for receiving pressurized lubricant to move the control slide towards the second position. The pump also has an electrical valve fluidly connected to the control chamber to control pressure therein. A first channel connects the control chamber and the electrical valve. Further, the pump has a pressure controlled valve moveable between a first valve position and a second valve position based on an output pressure of the pressurized lubricant delivered through the outlet. The pressure controlled valve is in the first valve position for the output pressure below a threshold level and in the second valve position for the outlet pressure that is at or above the threshold level. A second channel connects the pressure controlled valve and the control chamber, and a third channel vents the electrical valve. A fourth channel is connected to the third channel and the pressure controlled valve and configured for selective communication with the lubricant sump. A fifth channel connects the pressure controlled valve and the outlet. In its first valve position, the pressure controlled valve is inactive and a) closes fluid communication through the second channel to the control chamber, and (b) opens the fourth channel for communication to the lubricant sump thereby allowing the electrical valve to pressurize the control chamber by delivering fluid in through the first channel and vent the control chamber via the third and fourth channels. In its second valve position, the pressure controlled valve is active and (a) controls pressure in the control chamber via fluid communication from the outlet, through the fifth channel and through the second channel to the control chamber, and (b) closes fluid communication through the fourth channel to the lubricant sump, thereby pressurizing the control chamber via flow from the outlet to the control chamber. The pressure controlled valve is configured for selective movement to the second valve position via fluid communication through the fifth channel when the outlet pressure is at or above the threshold level and the electrical valve is disabled.

Another aspect provides a system that includes: an engine; a lubricant source containing lubricant and a variable displacement vane pump connected to the lubricant source for dispensing lubricant to the engine. The pump is connected to a lubricant sump for holding lubricant. The pump includes: a housing, an inlet for inputting lubricant from a source into the housing, and an outlet for delivering pressurized lubricant to the system from the housing. The pump also includes a control slide displaceable within the housing between a first slide position and a second slide position to adjust displacement of the pump through the outlet, a resilient structure biasing the control slide towards the first slide position, a rotor with at least one vane mounted in the housing and configured for rotation within and relative to the control slide, the at least one vane configured for engagement with an inside surface of the control slide during rotation thereof, and a control chamber between the housing and the control slide for receiving pressurized lubricant to move the control slide towards the second position. The pump also has an electrical valve fluidly connected to the control chamber to control pressure therein. A first channel connects the control chamber and the electrical valve. Further, the pump has a pressure controlled valve moveable between a first valve position and a second valve position based on an output pressure of the pressurized lubricant delivered through the outlet. The pressure controlled valve is in the first valve position for the output pressure below a threshold level and in the second valve position for the outlet pressure that is at or above the threshold level. A second channel connects the pressure controlled valve and the control chamber, and a third channel vents the electrical valve. A fourth channel is connected to the third channel and the pressure controlled valve and configured for selective communication with the lubricant sump. A fifth channel connects the pressure controlled valve and the outlet. In its first valve position, the pressure controlled valve is inactive and (a) closes fluid communication through the second channel to the control chamber, and (b) opens the fourth channel for communication to the lubricant sump thereby allowing the electrical valve to pressurize the control chamber by delivering fluid in through the first channel and vent the control chamber via the third and fourth channels. In its second valve position, the pressure controlled valve is active and (a) controls pressure in the control chamber via fluid communication from the outlet, through the fifth channel and through the second channel to the control chamber, and (b) closes fluid communication through the fourth channel to the lubricant sump, thereby pressurizing the control chamber via flow from the outlet to the control chamber. The pressure controlled valve is configured for selective movement to the second valve position via fluid communication through the fifth channel when the outlet pressure is at or above the threshold level and the electrical valve is disabled.

Yet another aspect of this disclosure provides a variable displacement vane pump for dispensing lubricant to a system. The pump is connected to a lubricant sump for holding lubricant. The pump includes a housing; an inlet for inputting lubricant from a source into the housing; and an outlet for delivering pressurized lubricant to the system from the housing. A control slide is displaceable within the housing between a first slide position and a second slide position to adjust displacement of the pump through the outlet. A control chamber is provided between the housing and the control slide for receiving pressurized lubricant to move the control slide towards the second position. An electrical valve is fluidly connected to the control chamber to control pressure therein. A pressure controlled valve is moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level. The pump also has a routing channel connecting the electrical valve and the pressure controlled valve, a feed channel connecting the pressure controlled valve and the control chamber, a venting channel for venting the electrical valve, and a supply channel connecting the pressure controlled valve and the outlet. In its first valve position, the pressure controlled valve is inactive and (a) allows fluid communication between the electrical valve and the routing channel, and (b) allows fluid communication between the feed channel and the control chamber to either pressurize or vent the control chamber. In its second valve position, the pressure controlled valve is active and (a) controls pressure in the control chamber via fluid communication from the outlet, through the supply channel and through the feed channel to the control chamber, and (b) closes fluid communication between the routing channel and the control chamber, thereby pressurizing the control chamber via flow from the outlet to the control chamber. The pressure controlled valve is configured for selective movement to the second valve position via fluid communication through the supply channel when the outlet pressure is at or above the threshold level and the electrical valve is disabled.

Still yet another aspect of this disclosure provides a variable displacement vane pump for dispensing lubricant to a system. The pump is connected to a lubricant sump for holding lubricant. The pump includes a housing, an inlet for inputting lubricant from a source into the housing, and an outlet for delivering pressurized lubricant to the system from the housing. A control slide is displaceable within the housing between a first slide position and a second slide position to adjust displacement of the pump through the outlet. A control chamber is provided between the housing and the control slide for receiving pressurized lubricant to move the control slide towards the second position. An electrical valve is fluidly connected to the control chamber to control pressure therein, and a valve channel connects the control chamber and the electrical valve. The pump has a pressure controlled valve moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level. The pump also has a routing channel connecting the electrical valve and the pressure controlled valve, a feed channel connecting the pressure controlled valve and the control chamber, a venting channel for venting the electrical valve, and a supply channel connecting the pressure controlled valve and the outlet. In its first valve position, the pressure controlled valve is inactive and (a) closes fluid communication through the feed channel, and (b) communicates the electrical valve to the lubricant sump via the routing channel and the venting channel, thereby allowing the electrical valve to pressurize the control chamber by delivering lubricant through the valve channel to pressurize the control chamber or to vent the control chamber via the routing channel and the venting channel. In its second valve position, the pressure controlled valve is active and (a) controls pressure in the control chamber via fluid communication from the outlet, through the supply channel and through the feed channel to the control chamber, and (b) closes fluid communication between the venting channel to the lubricant sump, thereby pressurizing the control chamber via flow from the outlet to the control chamber. The pressure controlled valve is configured for selective movement to the second valve position via fluid communication through the supply channel when the outlet pressure is at or above the threshold level and the electrical valve is disabled.

Other aspects and advantages of the present invention will become apparent from the following detailed description, the accompanying drawings, and the appended claims.

DETAILED DESCRIPTION OF THE PREFERRED EMBODIMENT(S)

As detailed herein, a variable displacement vane pump has pressure controlled valve moveable between a first valve position and at least a second valve position based on an output pressure of the pressurized lubricant delivered through the outlet and the status of an electrical valve. The pressure controlled valve (e.g., a pilot valve or a spool valve) provides an integrated fail safe function to the pump. The pressure controlled valve is inactive in the first valve position for an output pressure below a threshold level and is disabled, allowing an electrical valve (e.g., a variable current valve, a pulse width modulation (PWM) valve, or a solenoid valve) to control pressure in the control chamber of the pump as needed. In fail safe regulation mode, for example, when the electrical valve function is disabled, the pressure controlled valve takes over and moves towards or into its second valve position to control pressure in the control chamber (once pressure hits and/or exceeds the threshold). Channels and vents in the pump can be opened and closed based on the selective movement of the pressure controlled valve when the outlet pressure is at or above a threshold level.

As understood by one of ordinary skill in the art, "pump displacement" or "displacement" as used throughout this disclosure refers to a volume of liquid (lubricant) a pump is capable of moving during a specified period of time, i.e., a flow rate.

Figure 2:
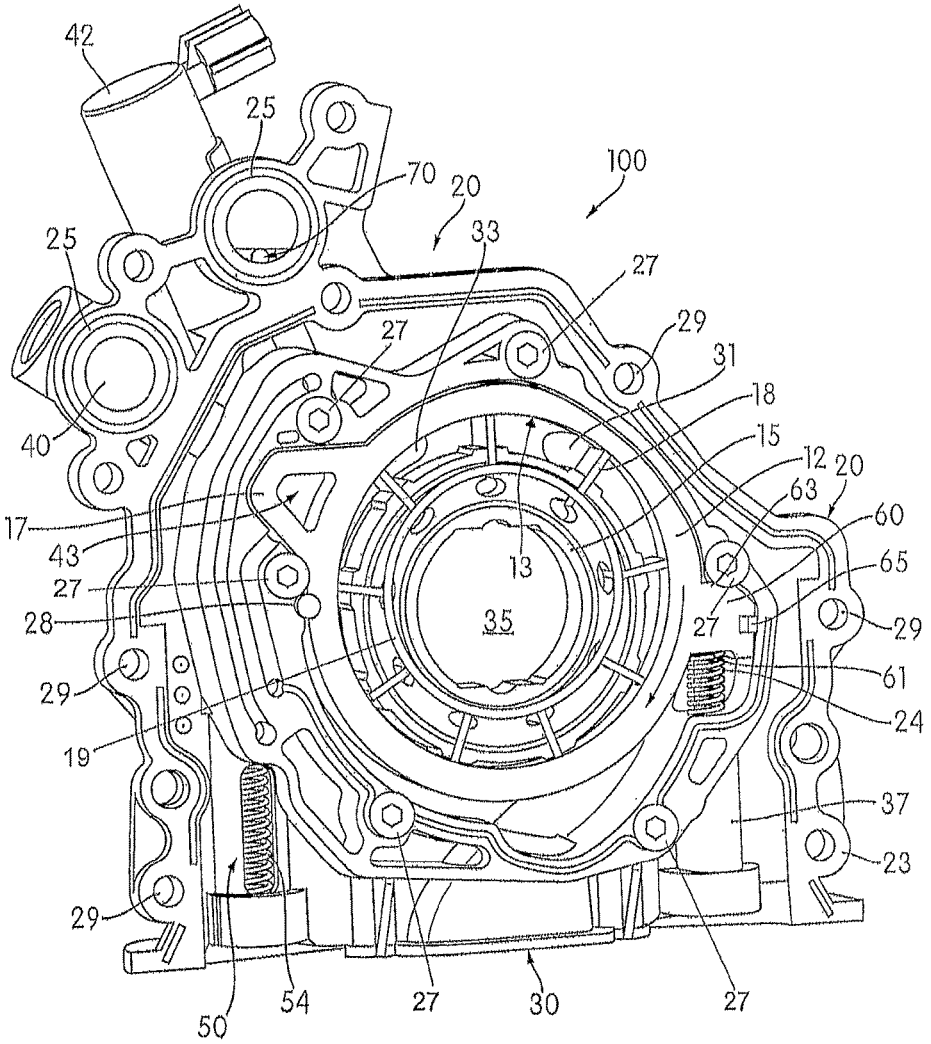
FIG. 2 is an underside perspective view of a pump housing having a control chamber, an electrical valve, channels, and a pressure controlled valve in accordance with an embodiment of this disclosure.

FIG. 2 is a perspective view of a pump 100 in accordance with an embodiment of the present disclosure. The pump 100 is a variable displacement vane pump for dispensing lubricant to a system in accordance with an embodiment. Pump 100 has a housing 20 with an inlet 30 and an outlet 40. The inlet 30 receives fluid or inputs lubricant to be pumped (typically oil in the automotive context) from a source 26 (see FIG. 18) into the housing 20, and the outlet 40 is used for discharging or delivering the pressurized fluid or lubricant to the system, e.g., engine, from the housing 20; and a lubricant sump (not shown) for holding lubricant. A control slide 12 (explained in greater detail below), a rotor 15, a drive shaft (not shown), and resilient structure 24 are provided in housing 20, as is generally known in the art. The pump shown in FIG. 2 has a single control chamber between the housing 20 and the control slide 12 for receiving pressurized lubricant to move the control slide 12. The inlet and outlet 30, 40 are disposed on opposing radial sides of the rotational axis of the rotor 15. As shown in FIG. 2, for example, the housing 20 has at least one inlet port 31 for intaking fluid to be pumped, and at least one outlet port 33 for discharging the fluid. The inlet port 31 and outlet port 33 each may have a crescent shape, and may be formed through the same wall located on one axial side or both axial sides of the housing (with regard to the rotational axis of the rotor 15). The inlet and outlet ports 31, 33 are disposed on opposing radial sides of the rotational axis of the rotor 15. These structures are conventional, and need not be described in detail. The shape of the inlet 30 and/or outlet 40 is not intended to be limiting. Other configurations may be used, such as differently shaped or numbered ports, etc. Further, it should be understood that more than one inlet or outlet may be provided (e.g., via multiple ports).

The housing 20 may be made of any material, and may be formed by aluminum die cast, powdered metal forming, forging, or any other desired manufacturing technique. The housing 20 encloses an internal control chamber (a single chamber). In the drawings, the main shell of the housing 20 is shown. Walls define axial sides of the internal chamber and a peripheral wall 23 extends around to surround the internal chamber peripherally, A cover (e.g., partially shown in FIG. 3) attaches to the housing 20, such as by fasteners 27 (e.g., see FIG. 2 for a top view of fasteners) (e.g., bolts) that are inserted into various fastener bores placed along or around the housing 20 (e.g., around and outside the rotor receiving space 35). The cover is not shown in FIG. 2, for example, so that some of the internal components of the pump can be seen. However, use of such cover is generally well known and need not be described in greater detail herethroughout. The cover may be made of any material, and may be formed by stamping (e.g., stamping steel or another metal), aluminum die casting, powdered metal forming, forging, or any other desired manufacturing technique. The drawings also show parts of and an underside of the cover, which helps enclose the internal control chamber of the pump 100 along with the housing 20. A gasket or other seal(s) may optionally be provided between the cover and peripheral wall 23 of the housing 20 to seal the internal chamber. Additional fastener bores (also shown in FIG. 2, without fasteners therein) for receipt of fasteners may be provided along the peripheral wall of the pump 100, to secure or fix the pump 100 to an engine, for example.

The housing 20 and cover includes various surfaces for accommodating movement and sealing engagement of the control slide 12, which will be described in further detail below.

The control slide 12 is displaceable within the housing 20 and relative to the cover between a first slide position and a second slide position (or in between the two positions) to adjust displacement of the pump 100 through the outlet 40 (e.g., as fed through the outlet port). The housing 20 may include a slide stop 63 and seal 65 for the control slide 12, for example. In accordance with an embodiment, the control slide 12 is pivotally mounted and configured for pivotal displacement within the housing 20 between the first and second slide positions. The first slide position is defined as a home position for maximum displacement. The second slide position is defined as a position away from the first slide position (or away from a position for maximum displacement), e.g., a reduced displacement position. More specifically, it can include any number of positions that is away from the first slide position, and may, in one embodiment, include when the slide is close to a minimum displacement position, or may be the minimum displacement position. For example, the control slide 12 can be pivotally mounted relative to the control chamber. When the control slide 12 pivots away from the first slide position, the control slide 12 can be considered to be in a second slide position, despite the angle of pivoting.

Specifically, in an embodiment wherein the control slide 12 pivots, a pivot pin 28 or similar feature may be provided to control the pivoting action of the control slide 12. The pivot pin 28 can be mounted to the housing 20. The configuration of the pivotal connection of the control slide 12 in the housing 20 should not be limited.

The pump 100 also has a rotor receiving space 35 (or pocket). The rotor receiving space 35 may have a configuration or shape that compliments the design, configuration, or shape of a drive shaft, such that it connects with the drive shaft that drives the rotor 15 of the pump. This rotor receiving space 35 communicates directly with the inlet and outlet 30, 40 for drawing in oil, lubricant, or another fluid under negative intake pressure through the inlet 30, and expelling the same under positive discharge pressure out the outlet 40.

The rotor 15 is rotatably mounted in the housing 20 within the rotor receiving space 35 of the control slide 12. The rotor 15 is configured for rotation within and relative to the control slide 12. The rotor 15 has a central axis that is typically eccentric to a central axis of the control slide 12. The rotor 15 is connected to a drive input in a conventional manner, such as a drive pulley, drive shaft, engine crank, or gear. As shown in FIG. 2, the receiving space 35 is central to the rotor 15.

The rotor 15 has at least one radially extending vane 18 mounted to the rotor 15 for radial movement and vane ring 19. The at least one vane 18 is configured for engagement with an inside surface of the control slide 12 during rotation thereof. Specifically, each vane 18 is mounted at a proximal end in a radial slot in the central ring of the rotor 15 in a manner that allows them to slide radially. Centrifugal force may force the vane(s) 18 radially outwardly to engage and/or maintain engagement between distal end(s) of the vane(s) and the inside or inner surface 13 of the control slide 12 during rotation thereof. This type of mounting is conventional and well known. Other variations may be used, such as springs or other resilient structures in the slots for biasing the vanes radially outwardly, and this example is not limiting. Thus, the vane(s) 18 can be sealingly engaged with the inner surface 13 of the control slide 12 e.g., by the vane ring 19, such that rotating the rotor 15 draws fluid in through the inlet 30 by negative intake pressure and outputs the fluid out through the outlet 40 by positive discharge pressure. Because of the eccentric relationship between the control slide 12 and the rotor 15, a high pressure volume of the fluid is created on the side where the outlet 40 is located, and a low pressure volume of the fluid is created on the side where the inlet 30 is located (which in the art are referred to as the high pressure and low pressure sides of the pump). Hence, this causes the intake of the fluid through the inlet 30 and the discharge of the fluid through the outlet 40. This functionality of the pump is well known, and need not be detailed further.

The control slide 12 can be moved (e.g., pivoted) to alter the position and motion of rotor 15 and its vane(s) relative to the inner surface 13 of the slide 12, and, thus, alter the displacement of the pump and distribution of lubricant through the outlet 40. Typically, the resilient structure 24 may bias or urge the control slide 12 in or towards its first slide position (or first pivotal direction or position, or a maximum displacement position). A pressure change in the control chamber (the chamber between the outside shape of the slide and the pump housing, between the pivot pin 28 on the left side and the seal 65 at the right side of the slide) can result in the control slide 12 moving or pivoting (e.g., centering) relative to the rotor 15, adjusting (e.g., reducing or increasing) displacement of the pump. The slide 12 may be moved based on the pressure of the lubricant being fed through inlet 30 via inlet port 31 towards outlet 40. In accordance with an embodiment, the min/max positions of the slide 12 in pump 10 are controlled by an electrical valve 42, which controls the pressure in the control chamber behind the slide 12 and, as a consequence, influences the slide position and the pump displacement, Although "electrical valve" is used throughout this disclosure, it should be understood that an electrical valve as noted herein is defined as a regulating valve that may be energized and controlled by an electrical signal, e.g., an electric current. It should be understood that an "electrical valve" in this disclosure may be an electro-mechanical valve. In one embodiment, the electrical valve is a variable current valve. In another embodiment, the electrical valve is a pulse width modulation (PWM) valve. In yet another embodiment, the electrical valve is a solenoid valve. Accordingly, the type of electrical valve used in the pump 100 is not intended to be limiting.

The first slide position is the position or direction that increases the eccentricity between the control slide 12 and rotor axes. As the eccentricity increases, the flow rate or displacement of the pump increases. Conversely, as the eccentricity decreases, the flow rate or displacement of the pump also drops. In some embodiments, there may be a position where the eccentricity is zero, meaning the rotor and ring axes are coaxial. In this position, the flow is zero, or very close to zero, because the high and low pressure sides have the same relative volumes. Accordingly, in an embodiment, the first slide position of the control slide 12 is the position or direction for maximum offset or displacement of the pump 100, while the second slide position of the control slide 12 is the position or direction for reduced, limited, or minimal offset or displacement. Again, this functionality of a vane pump is well known, and need not be described in further detail.

In the illustrated embodiment, the resilient structure 24 is a spring, such as a coil spring. In accordance with an embodiment, the resilient structure 24 is a biasing member for biasing and/or returning the control slide 12 to its default or biased position (first or home slide position for maximum eccentricity with the rotor 15). The control slide 12 can be moved against the spring or resilient structure to decrease eccentricity with the rotor 15 based on the pressure within the housing 20 to adjust displacement and hence output flow. The housing 20 may include a receiving portion 37 for the resilient structure 24, partially shown in FIG. 2, for example, defined by portions of the peripheral wall 23, for example, to locate and support the structure (or spring). The receiving portion 37 may include one or more side walls to restrain the structure 24 against lateral deflection or buckling, and a bearing surface against which one end of the spring is engaged. The control slide 12 includes a radially extending bearing structure 60 defining a bearing surface 61 against which the resilient structure 24 is engaged, for example. Other constructions or configurations may be used.

A plurality of seals may be provided between the housing 20/cover and the control slide 12, for example.

As detailed above, pressure is used to control the distribution or delivery of lubricant by the pump 100. The control pressure can be, for example, the pump outlet pressure or the engine gallery feedback pressure. The control pressure may be used to control parts of the pump so that the desired amount of pressurized lubricant is delivered to the system, e.g., engine. Further details regarding control based on pressure are provided later with reference to FIGS. 4-8.

Figure 1:
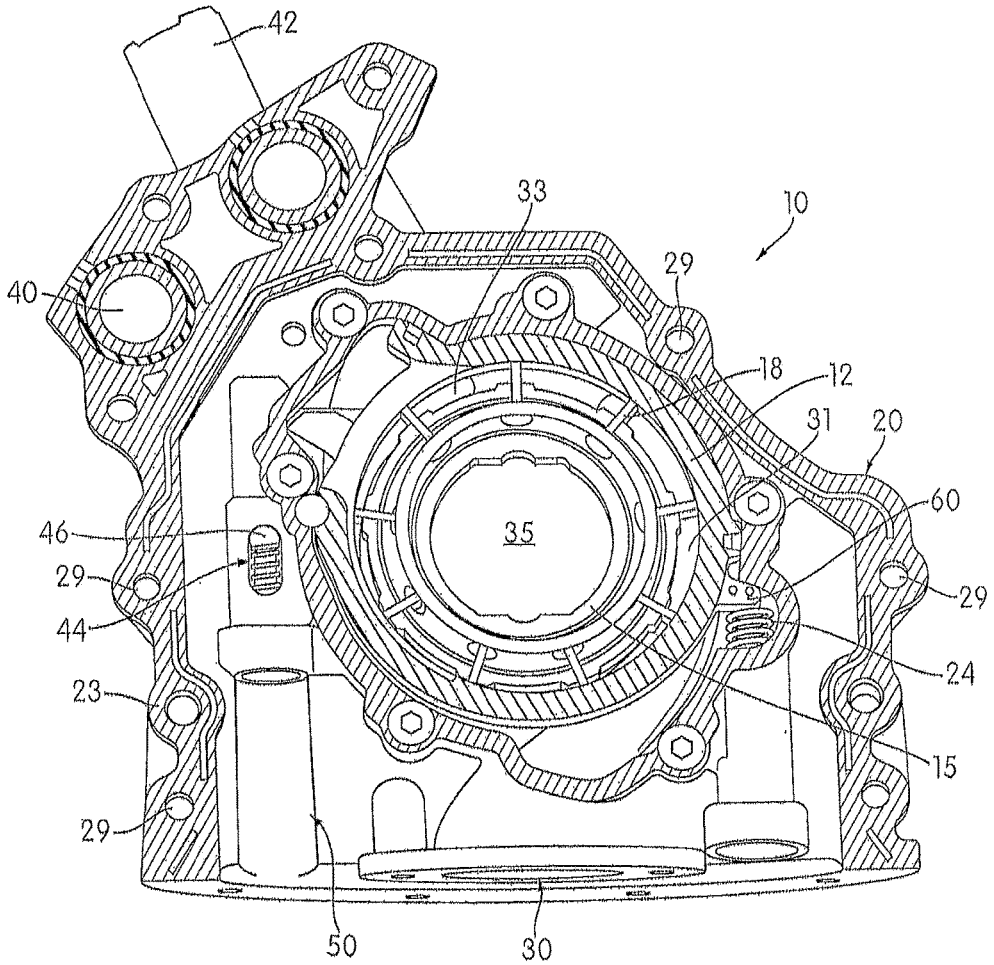
FIG. 1 PRIOR ART
FIG. 1 is a perspective view of part of a pump housing having two pressure chambers and an electrical valve as known in the art.

FIG. 1 is a perspective view of part of a pump housing 10 (without a cover), having two pressure chambers (a higher pressure chamber and a lower or regulated pressure chamber) and electrical valve 42, as generally known in the art. The outlet pressure from the outlet port 33 to the outlet 40 acts on the [higher] pressure chamber of the pump as needed, and the electrical valve 42 acts on the regulated pressure chamber. This illustrated pump also has a valve housing 50 therein for a standard panic valve 44 that includes a ball valve 46 with spring (shown in part, via a window). The panic valve 44 is connected at the top to the pump outlet 40 (left side of the pump). The panic valve 44 provides a bypass on the outlet 40 that is designed to reduce and adjust the pressure on the outlet. For example, by opening or moving the ball valve 46 (via the pressure of the lubricant) the bypass can be opened quickly to reduce the pressure and protect the engine and parts around it.

However, in this type of design, the control function of the pump is limited, including when the pressure level on the outlet 40 exceeds a certain amount. That is, there is a pump pressure limitation provided by the outlet channel of outlet 40, that is providing a force to the control slide 12 in the first chamber, between the pivot point 28 and the seal at the top of the control slide 12. It works against the spring and moves the control slide 12 clockwise to a lower displacement position. Thus, because this function is always active, it influences the control function of the electrical valve 42 working on the second control chamber, and may limit the control function of the entire pump 10. This, in turn, could raise the cold temperature pressure (e.g., by 5 or 6 barometer), which risks problems related to damaging the filter or cooler for the lubricant.

Other disadvantages include that such a two chamber design has a very small high pressure chamber, which does not allow for a wide regulation range in a modulation (e.g., PWM) mode (in fact, it can provide a reduced regulation range). Also, due to the small high pressure chamber, there tends to be very poor regulation characteristics in fail safe mode. Further, there is high temperature drift in the pump when running in fail safe mode. The spring rate is also critical to define for both chamber functions when using a valve like panic valve 44.

Another prior art design includes a single chamber pump with an integrated fail safe function on a PWM valve (not shown in Figures). This type of integrated fail safe function controls the pump pressure to a fail safe pressure level, which is typically a pressure level slightly higher than the controlled pressure level, in case the PWM valve fails electrically. If the PWM valve fails mechanically, however, this type of known fail safe function may not work any longer.

Generally, a single chamber designed pump has a better regulation range due to its increased chamber size (e.g., as compared to two smaller chambers). The control of the spring rate can also be designed to regulation requirements. In some cases, the fail safe function is achieved by valve piston inside the electrical valve having two diameters (e.g., a bigger diameter and a smaller diameter). However, such a design for the fail safe function adds significant costs to the electrical valve. There also tends to be a temperature drift in fail safe function due to the high spring rate in the valve. Further, the specific fail safe pressure requires an individual valve for each application.

Accordingly, as will become further evident below, the herein disclosed variable vane pump has been designed to include a pressure controlled valve (e.g., controlled by gallery or outlet feedback), along with an electrical valve, to have a closed loop controlled pump that controls gallery pressure by the engine ECU depending on engine speed, engine load, and temperature. The pressure controlled valve may be controlled a number of ways, as described in greater detail in the embodiments below. The disclosed pump with this combination of valves satisfies at least the customer requirement or expectation that the pump is operational for a minimum amount of distance (e.g., ~30 000 km) or time under a fail safe function with controlled oil/lubricant pressure when there is electrical or mechanical failure in the electrical valve. This disclosure also provides a pump that may regulate over temperature and speed without exceeding a predetermined or threshold pressure (e.g., ~8 bar), which is typically not realized by prior art systems that only use a pressure relief valve (e.g., due to possible pump damage, running in 100% displacement) in fail safe conditions.

The pump shown in FIG. 2 has a single control chamber between the housing 20 and the control slide 12 for receiving pressurized lubricant to move the control slide 12 towards the second position. An electrical valve 42 is also shown as part of pump and controls the pressure of the pump, depending on the engine conditions, e.g., engine speed, temperature, engine load, etc. The electrical valve 42 is configured to receive pressurized lubricant from the gallery, for example. When energized, the electrical valve 42 delivers lubricant to the control chamber in the pump; otherwise, when disabled or de-energized, any feedback from the gallery is stopped at the electrical valve 42.

In addition, the pump of FIG. 2 has a pressure controlled valve 52 (see FIG. 3) provided in a valve housing 50. The disclosed valve 52 can replace the prior-art panic valve, and may be a pilot valve, for example. In an embodiment, the disclosed pressure controlled valve 52 fits in the same space or valve housing 50 as a known panic valve (such as valve 44). That is, in an embodiment, the valve housing 50 may be machined into the pump housing (or cover) such that the housing 50 is formed integrally as part of the pump. Accordingly, parts of the valve 52, such as those discussed below (e.g., valve body 51/piston and spring 54), may be placed into the pump housing in the designated area. In another embodiment, the valve housing 50 may be designed to contain parts of the valve 52, such that the housing 50 may be inserted into a designated area the pump 10.

Figure 3:
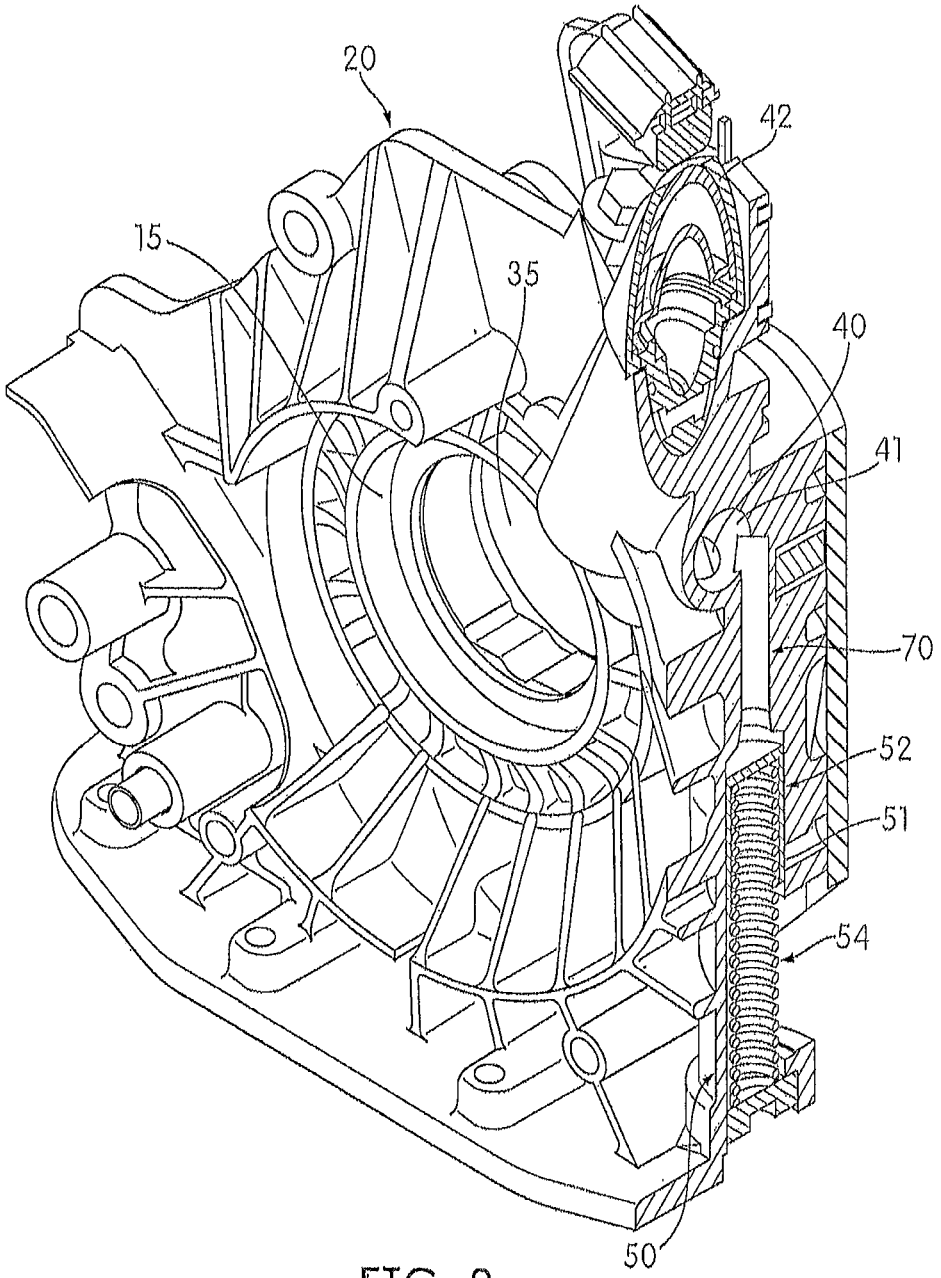
FIG. 3 is a topside perspective and sectional view of the pump housing of FIG. 2.

The pressure controlled valve 52 is moveable between a first valve position and at least a second valve position within valve housing 50 based on an output pressure of the pressurized lubricant delivered through the outlet 40. The pressure controlled valve 52 has a direct connection to the pump outlet 40 via connection channel 41, as shown in FIG. 3, for example. The pressure controlled valve 52 is inactive in the first valve position for the output pressure below a threshold level (and when the electrical valve 42 is energized or implemented) and is active near or in the second valve position for the outlet pressure that is at or above the threshold level. The valve 52 may be activated to move towards or into the second valve position and place the pump 100 in a fail safe mode to control the maximum pump pressure in case of electrical valve 42 failure or deenergization. That is, when the electrical valve 42 fails, the valve 52 may take over and may be used to balance pressure forces of oil/lubricant pressure through channels in the pump housing, e.g., by limiting the pump pressure, e.g., over a speed range.

As will become evident by the description below, the fail safe function of the disclosed embodiments of pumps combines the previously described panic valve functions, along with additional functions, particularly during electrical valve failure, or when the valve is disabled or de-energized.

Figure 9:
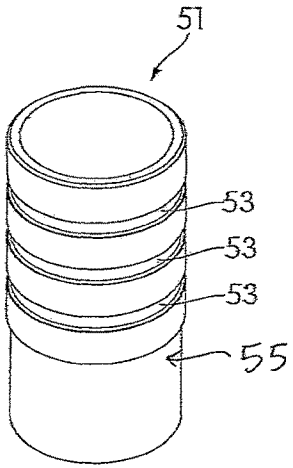
FIG. 9 shows a perspective view of a pressure controlled valve with stepped configuration used in the pump housing in accordance with an embodiment of this disclosure.

The pressure controlled valve 52 includes a valve body 51 (or piston) (see FIG. 9) and a spring 54 as provided in the valve housing 50. As shown in FIG. 3, for example, the spring 54 biases the valve body 51 in an upward direction towards the outlet connection 41 connected to the outlet 40 of the pump. The position of the valve body 51 is configured to alter the movement of lubricant through the pump housing 20 and through the outlet 40 (or gallery), In an embodiment, as shown in FIG. 9, for example, the valve body 51 includes a number of indentations 53 or grooves therein that, based on the position of the valve body 51 within the valve housing 50, may receive lubricant therein, Should pressurized lubricant come through one or more of the herein described channels (e.g., channels 74-78) of the pump, the valve body may aid in balancing pressure forces of oil pressure through channels in the pump housing.

Moreover, as noted above, the pump of FIG. 2 includes a number of channels therein to aid in controlling the fail safe function (via the pressure controlled valve 52) of the pump.

Figure 5:
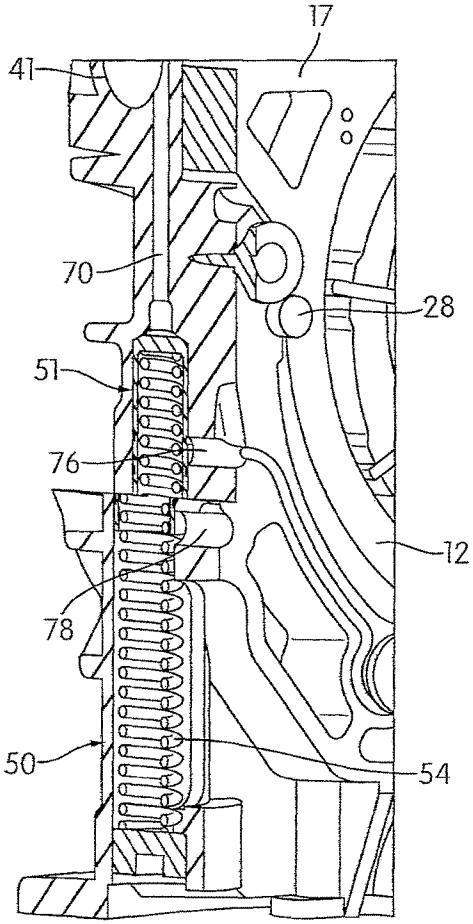
Figure 4:
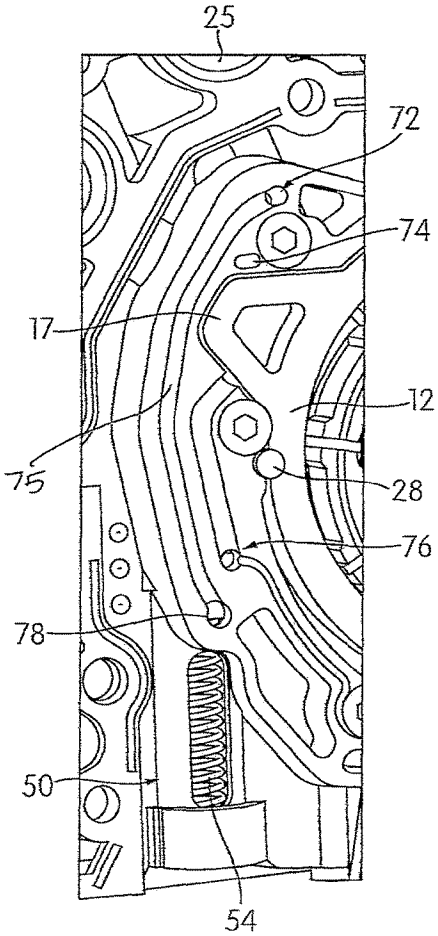
FIG. 4 is a detailed underside view of the pressure controlled valve and channels in the pump housing, in accordance with an embodiment.

As seen in FIGS. 4 and 5, for example, a first channel 74 (or valve channel) connects the electrical valve 42 to the control chamber of the pump 100. A second channel 76 (or feed channel) is provided in the pump connecting the pressure controlled valve 52 and the control chamber. The second channel 76 is configured for selective fluid communication with the control chamber. During regular functioning and use of the pump 100, for example, the first channel 74 is used for selective communication of lubricant between the control chamber and electrical valve 42 (when needed). Communication of lubricant to the control chamber via the second channel 76 may be allowed during fail safe conditions, for example (e.g., based on pressure forces from the lubricant), but not during normal operation of the pump. Thus, under normal operation, fluid communication through the second channel 76 to the control chamber is closed via pressure controlled valve 52. A third channel 72 and a fourth channel 78 interconnect to connect the electrical valve 42 and the lubricant sump. That is, as shown in FIG. 4, the third channel 72 is connected to fourth channel 78 via a passage 75 to route fluid from the valve 42 to the sump. The fourth channel 78 is configured for selective fluid communication with the lubricant sump, based on the position of the pressure controlled valve 52. A fifth (supply) channel 70 (as seen in FIG. 3 and FIG. 5) connects the pressure controlled valve 52 and the outlet 40.

In an embodiment, second channel 76 and third channel 72 are newly added to pump housing. That is, the second and third channels 76, 72 may be added to (e.g., machined in) an existing pump housing.

In operation, the pressure controlled valve 52 is configured for selective movement into and between its first and at least second positions based on the pressure level through the outlet 40 and connection 41, based on if the electrical valve 42 is properly operating. In fail safe mode, when the electrical valve fails to control the pump 100, the pressure controlled valve 52 is moved from its first (inactive) position towards and/or into its second (active) position. For example, the pressure controlled valve 52 is configured for selective movement to the second valve position via fluid communication through the fifth channel 70 when the outlet pressure is at or above the threshold level.

The electrical valve 42 is connected to the feedback from the gallery or outlet 40. Generally, as known in the art, the electrical valve 42 is used to control the pump under all normal operating or lower pressure conditions. However, when the outlet pressure exceeds a predetermined or threshold amount and/or if a controller associated with the pump fails, thus causing the electrical valve to fail, the pressure controlled valve 52 takes over. Accordingly, the pressure controlled valve 52 as disclosed herein controls the pressure in the control chamber via firstly overruling the (failed) electrical valve 42 and secondly supplying pressure into the control chamber and reduces the pressure within the housing 20. It indirectly controls the pressure in the pump via its connections with (or closing off of) the fourth channel 78 to the electrical valve 42 and thus closing communication from the electrical valve 42 to the sump. By (at least partially) closing the connection of the electrical valve 42 to the sump in the second pilot valve position, (i.e., fourth channel 78 is closed via movement of the pilot valve 52), a significant loss of pressure from the control chamber to the oil sump—due to the failed electrical valve 42—is prevented. As the pressure of the lubricant through the outlet 40 exceeds a predetermined or threshold amount, only the pressure controlled valve 52 is activated, thus overruling the electrical valve 42 to take control of the pump and alter and secure the pressure such that it does not exceed the predetermined or threshold level. Accordingly, the pressure controlled valve 52 acts in a panic mode function, and only when required. The electrical valve 42 is otherwise used to control the pump under stable or normal conditions, when needed.

Figure 6:
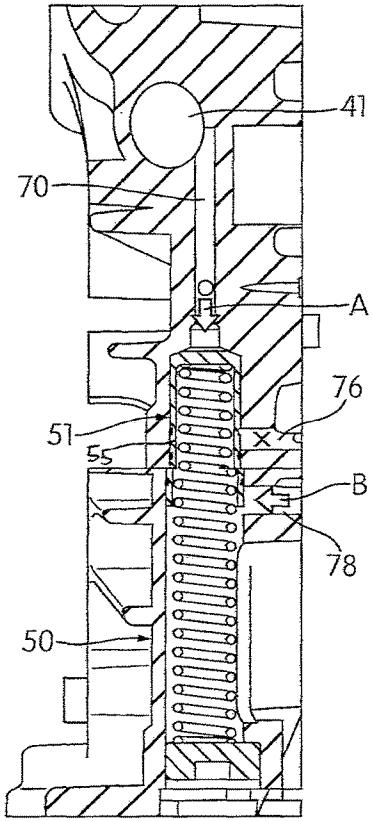
FIGS. 5 and 6 show detailed underside and sectional views of the pressure controlled valve in a first valve position in the pump housing, in accordance with an embodiment.

In operation, when the fail safe function of the pump is off and the pressure controlled valve 52 is in its first valve position, as shown in FIG. 5 and FIG. 6, the pressure controlled valve 52 is biased to its first valve position, or a closed, inactive, or default position. The spring 54 pushes the valve body 51 in an upward direction, thus disabling the fail safe function. Fluid communication is allowed through the first channel 74 via the electrical valve 42 to pressurize the control chamber, along with venting to the lubricant sump via the third channel 72 and the fourth channel 78 (as indicated by arrow B), while fluid communication is closed through the second channel 76, in the first (inactive) position, i.e., during regular operation of the pump. That is, the valve 52 closes the feed from the outlet 40 to the control chamber, and instead the control chamber is vented through the third channel 72. Further, the valve 52 opens the fourth channel 78 to feed lubricant to the sump. The electrical valve 42 may be used to control the pressure in the pump (thus operating the pump in a regulation mode) during normal operation.

Figure 8:
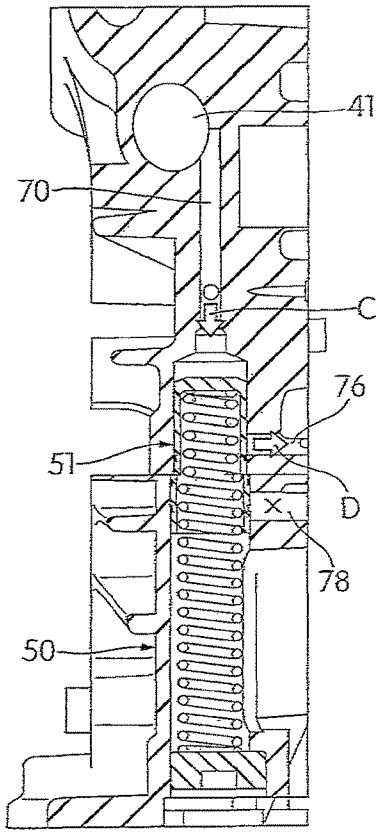
FIGS. 7 and 8 show detailed underside and sectional views of the pressure controlled valve in a second valve position in the pump housing, in accordance with an embodiment.
Figure 7:
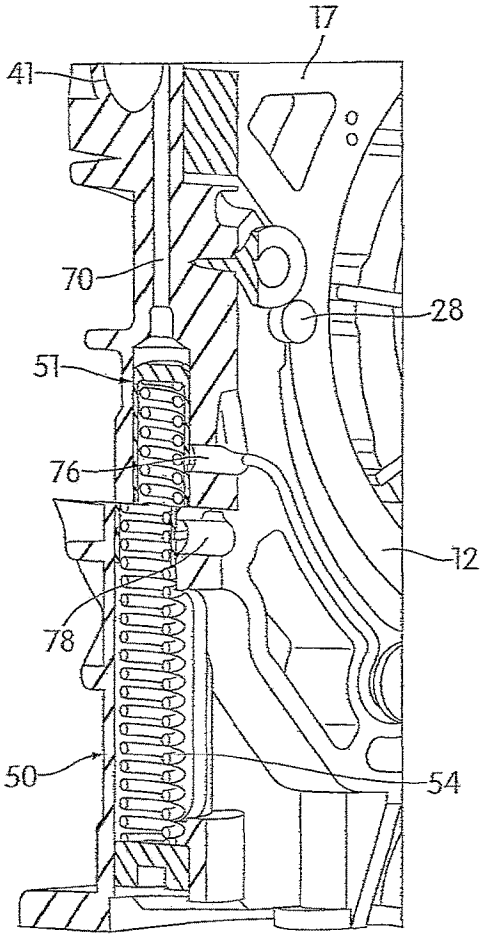

Once the outlet pressure of the lubricant exceeds a predetermined or threshold amount, and the electrical valve 42 fails, the outlet pressure may act on the pressure controlled valve 52 and moves it towards and/or to its second valve position. The pressure controlled valve 52 is configured to control pressure in the control chamber via fluid communication through the second channel 76, depending on the electrical valve 42 failed position. The predetermined or threshold amount of pressure for activating the valve 52 may be based on a customer's specifications, for example. In an embodiment, the valve opening pressure (i.e., the pressure for activating the pressure controlled valve 52 and moving it to its second position to act as a fail safe) is approximately 7 bar. For example, when the pressure through the fifth channel 70 directed to the valve body 51, as indicated by arrow A in FIG. 6, is less than 7 bar (or any predetermined or threshold amount), the valve 52 remains in its first valve position as shown in FIGS. 7-8. However, when the pressure is at or exceeds ~7 bar (or the predetermined, threshold, or selected amount), the valve 52 may be moved to its second valve position. The outlet pressure acts on the valve body 51 and against the spring 54 and pushes the valve 52 (i.e., the valve body 51) down within/relative to the valve housing 50 (as shown by arrow C in FIG. 8) so that the lubricant flows through the fifth channel 70.

In (or near) its second valve position, i.e., during higher outlet pressure incidents where a panic or fail safe function is implemented, or in a fail safe regulation mode, as shown in FIG. 7 and FIG. 8, the pressure controlled valve 52 may be moved via pressure from the lubricant in the housing. Further, in fail safe regulation mode, the function of the electrical valve 42 may be disabled from controlling the pressure in the control chamber and closed. The pressure controlled valve 52 may then take over and be opened to its second position to vent the pressure from the control chamber. Specifically, the pressure controlled valve 52 may be configured to take over and control pressure in the control chamber via moving to its active position and allowing fluid communication from the outlet 40 (e.g., via outlet channel 41), through the fifth channel 70 and through the second channel 76 to the control chamber. The valve 52 also closes fluid communication through the fourth channel 78, thereby pressurizing the control chamber via flow from the outlet 40 to the control chamber. That is, the valve 52 opens the feed from the outlet 40 to the control chamber by allowing flow through the fifth channel 70 and the second channel 76, as indicated by arrow C and arrow D in FIG. 8. The lubricant received through the second channel 76 pressurizes and acts on the slide in the control chamber to regulate the pump.

Further, in accordance with an embodiment, to achieve acceptable pump regulation, the connection of the outlet channel 41 and the second channel 76 is throttled by a reduced diameter portion 55 (relative to a lower part of the valve body near channel 78) with indentations 53 along the upper part of the valve body 51 to regulate the flow into the control chamber. The control chamber is vented through the first channel 74 back to the electrical valve 42 (which is open and not energized or controlling the pump). The valve closes the connection of the vent of the electrical valve 42 (via third channel 72 and fourth channel 78) to allow the pump outlet pressure to build up in the control chamber to regulate the pump.

Accordingly, the pressure controlled valve 52 as disclosed herein is a proportionally controlled valve that controls the pressure in the control chamber without use of the electrical valve 42 (e.g., such as when the valve 42 fails). It indirectly controls the pressure in the pump via its controlled connections with the channels (e.g., channels 72, 74, 76, 78) to the outlet and/or to the sump to secure a maximum pressure level that is not higher than a predetermined or threshold amount. That is, the valve 52 may move to a second position, opening up the pressure channel(s) to move the control slide 12 and control the pump outlet pressure. The valve may do so by, for example, moving to find a position, e.g., its second position, that opens up the channel(s) at least partially (e.g., via only on a small cross section—a fully open channel or channels is not necessary) so that it may find a balance between the outlet pressure and the control pressure (control pressure for the slide is significantly lower than the outlet pressure), or by moving relatively up and down (back and forth into and/or between its first and second positions) to balance the outlet pressure. The positions of the valve 52 result in different feeds of the control chamber to control the pump pressure. As the pressure of the lubricant through the outlet 40 exceeds a predetermined or threshold amount, only the pressure controlled valve 52 is activated, thus overruling the electrical valve 42 to take control of the pump and alter and secure the pressure such that it does not exceed the predetermined or threshold level. Accordingly, the pressure controlled valve 52 acts in a panic mode function, i.e., only when required, to protect the engine from excessive pressure and damage. The valve 52 keeps the pressure level low in the pump 100 in case of electrical valve failure (compared to a standard panic valve function) and results in lower drive torque and lower power consumption of the pump, thus also keeping fuel consumption at low level for these conditions. The valve 42 is otherwise used to control the pump under stable or normal conditions as needed.

In accordance with an embodiment, the pressure controlled valve 52 (i.e., its valve body 51) is optionally moveable between more than two positions, e.g., into and/or between a first valve position, a second valve position, and at least a third valve position, within valve housing 50, based on an output pressure of the pressurized lubricant delivered through the outlet 40. The pressure controlled valve 52 may be inactive in the first valve position for the output pressure below a threshold level and is active near or in the second valve position and/or near or in a third valve position for an outlet pressure that is at or above a threshold level, for example. The valve 52 may be activated to move towards or into the second valve position and/or third valve position and place the pump 100 in a fail safe mode to control the maximum pump pressure in case of electrical valve 42 failure. When the electrical valve 42 fails, the valve 52 may take over and may be used to balance pressure forces of oil/lubricant pressure through channels in the pump housing, e.g., by limiting the pump pressure, e.g., over a speed range, in any number of positions. The valve 52 may move further within the valve housing 50 (e.g., further down, with reference to the FIGS.) into its third position, and, optionally, further open up channel(s) within the housing and/or open up an additional and/or separate cross section of a channel or port (not shown) that is connected to the tank or sump, for example, so that the outlet pressure is (further) reduced.

Figure 10:
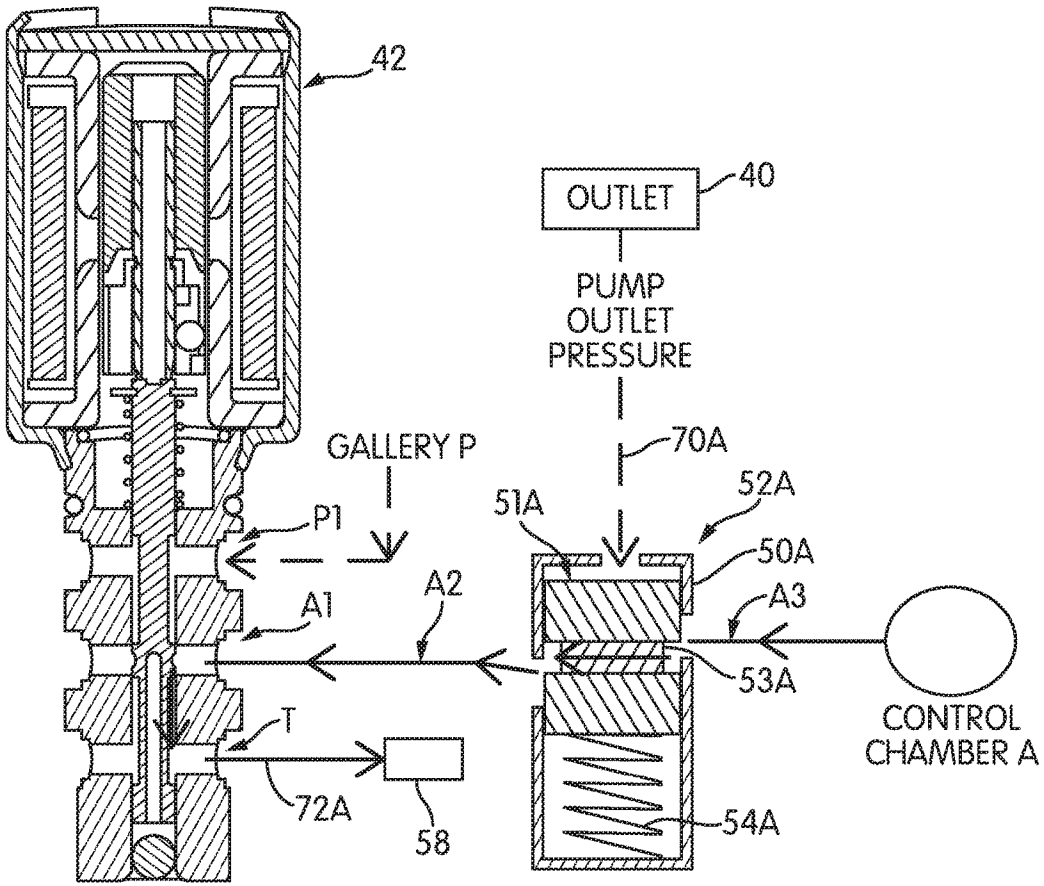
FIG. 10 is a schematic view of parts associated with a pump housing including a control chamber, an electrical valve with ports, channels, and a pressure controlled valve in accordance with another embodiment of this disclosure.
Figure 11:
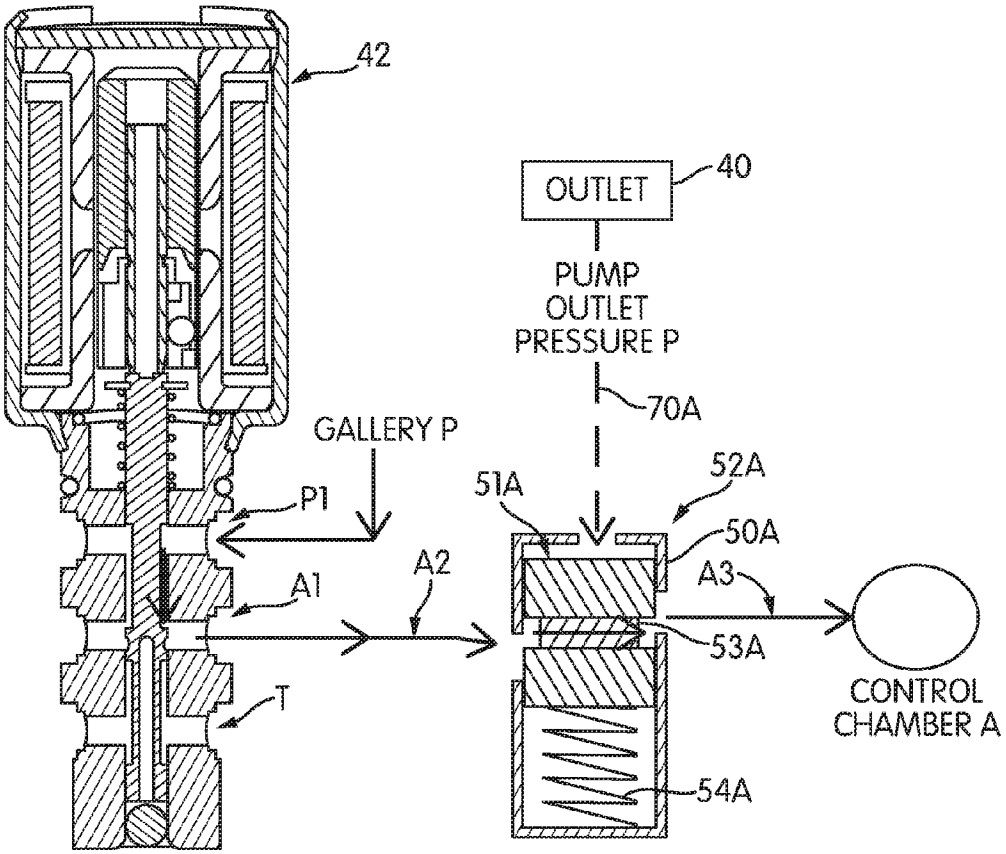
FIG. 11 shows a schematic diagram illustrating flow of lubricant and use of the parts of FIG. 10 when the pressure controlled valve is in a first valve position in the pump housing, in accordance with an embodiment.
Figure 12:
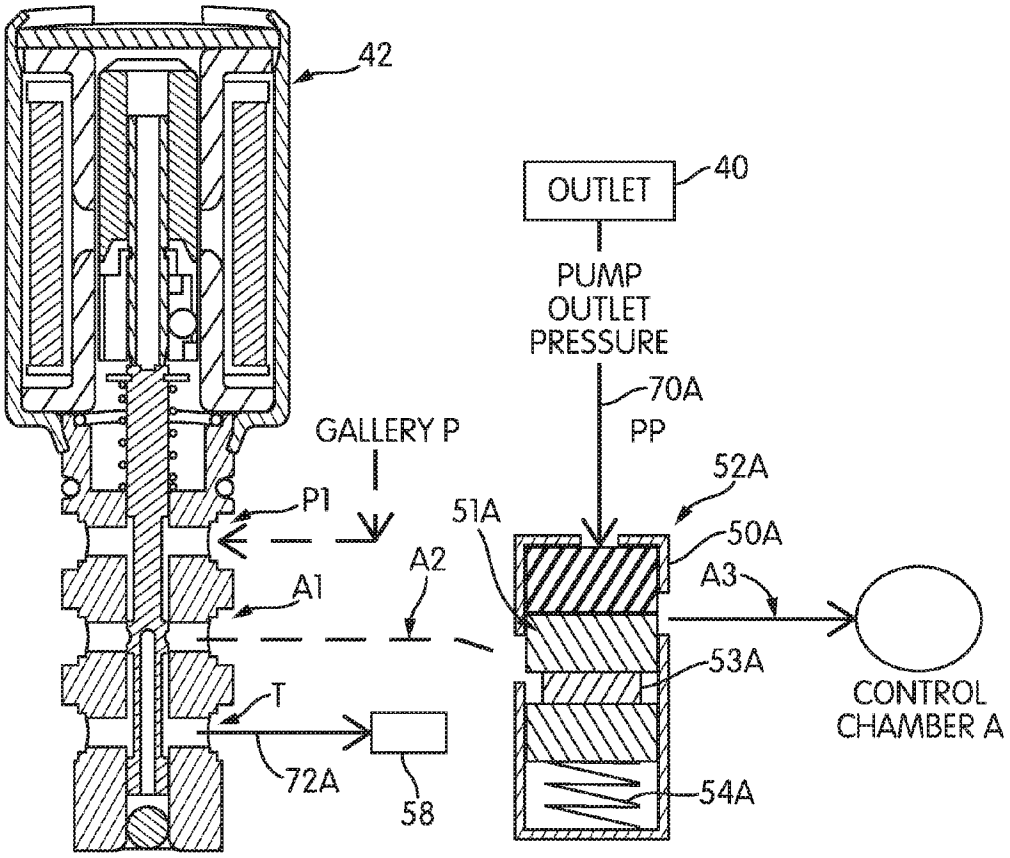
FIG. 12 shows a schematic diagram illustrating flow of lubricant and use of the parts of FIG. 10 when the pressure controlled valve is in a second valve position in the pump housing, in accordance with an embodiment.

FIGS. 10-12 are schematic views of parts associated with a pump housing in accordance with another embodiment. For simplicity purposes only, similar parts as described and noted above with respect to FIGS. 1-9 have been labeled with the same reference numbers in FIGS. 10-12. Accordingly, it should also be understood that the features previously noted above with respect to those parts similarly apply to each of the embodiments of FIGS. 10-12 and thus are not necessarily repeated here and below. The pump of FIGS. 10-12 includes a single control chamber A (between the housing and the control slide, both not shown), an electrical valve 42, a pressure controlled valve 52A, and a number of channels.

The electrical valve 42 includes a port P1 that is connected to the gallery P of the pump via an inlet channel or passage. It also includes a port A1 and a port T. Port A1 is configured for selective fluid communication with a routing channel A2 that connects the electrical valve 42 and the pressure controlled valve 52A. Port T is configured for selective fluid communication with a venting channel 72A for venting the electrical valve 42 and connected control chamber (similar to the third channel 72 in the prior embodiment).

The pressure controlled valve 52A is provided in a valve housing 50A and is designed to control delivery of the lubricant or fluid via port A1 of the electrical valve 42 (further described below). That is, in an embodiment, the valve housing 50A may be machined into the pump housing (or cover) such that the housing 50A is formed integrally as part of the pump, and parts of the valve 52A (e.g., valve body 51A/piston and spring 54A) may be placed into the pump housing in the designated area. In another embodiment, the valve housing 50A may be designed to contain parts of the valve 52A, such that the housing 50A may be inserted into a designated area of the pump. Like the previously described valve 52, valve 52A is moveable between a first valve position and at least a second valve position within valve housing 50 based on an output pressure of the pressurized lubricant delivered through the outlet 40. The disclosed valve 52A can replace the prior-art panic valve, and may be a spool control valve, for example. In an embodiment, the disclosed pressure controlled valve 52A fits in the same space or valve housing as a known panic valve (such as valve 44). The pressure controlled valve 52A includes a valve body 51A (or piston) and a control spring 54A is provided in the valve housing 50A. As shown in FIG. 10, for example, the spring 54A biases the valve body 51A in an upward direction towards channel 70A connected to the outlet 40 of the pump. In an embodiment, the valve body 51A includes a reduced diameter portion 53A that, based on the position of the valve body 51A within the valve housing 50A and its alignment with openings of channels in the pump housing, may aid in directing lubricant therethrough.

Also seen in FIG. 10 is a feed channel A3 connecting the pressure controlled valve 52A and the control chamber A, and a supply channel 70A connecting the outlet and the pressure controlled valve 52A. In operation, the pressure controlled valve 52A is configured for selective movement into and between its first and at least second positions based on the pressure level through the outlet 40 and into valve 52A (via channel 70A), based on if the electrical valve 42 is properly operating.

During normal operation of the pump, the electrical valve 42 may not be energized, as shown in FIG. 10. The pump outlet pressure is below a fail safe/pressure set point, and thus the pump may run up to or at full displacement (maximum displacement) while below the set or threshold pressure. Any gallery pressure supply P of lubricant to electrical valve 42 is stopped or limited at the port P1 since the valve is not energized. The control spring 54A of pressure control valve 52A pushes the valve body 51A upwardly (e.g., to or towards a maximum stop position, also referred to as its first position), thus opening flow from the control chamber A to the electrical valve 42. Specifically, pressurized fluid is delivered from control chamber A, through feed channel A3, through valve 52A, through routing channel A2, and to the electrical valve 42 via port A1. Pressurized fluid is directed from port A1 to port T and vents through the venting channel 72A to the sump or tank. Accordingly, the control chamber A may be vented via delivery through A3→A2→A1→T during normal operation.

FIG. 11 illustrates an example of controlling the pump during normal operation using the A1 port of the electrical valve 42 when the electrical valve 42 is activated, i.e., the valve 42 is energized and the pump is a regulated displacement to control pressure in the pump (e.g., operating the pump in a regulation mode). In the illustrated configuration, the pressure controlled valve 52A is inactive, i.e., moved to or biased towards its first position. The pump outlet pressure is below a fail safe/pressure set point (or threshold pressure), and thus the pump may run below and up to a preset fail safe pressure by pressurizing the control chamber A via the electrical valve 42. The gallery pressure supply P of lubricant flows to the electrical valve from port P1 to port A1. The control spring 54A of pressure control valve 52A pushes the valve body 51A upwardly, thus maintaining (or opening) flow. However, in this mode, when the pressure controlled valve 52A is in its first position, flow is directed from the electrical valve 42 to the control chamber A. Specifically, pressurized fluid is delivered from gallery to port P1, and is communicated from port A1 through the routing channel A2 and to the valve 52A. Once guided through the valve body 51B (e.g., via alignment of reduced diameter portion 53A with openings for channels A2 and A3), pressurized fluid is communicated from the valve 52A, through the feed channel A3, to pressurize the control chamber A. Thus, the ports in the electrical valve 42 supply lubricant to the control chamber A. Accordingly, the control chamber A may be pressure supplied from P1→A1→A2→A3 during normal operation when the electrical valve 42 is activated/energized.

When the pump needs to be operated at regulated displacement in a fail safe mode due to failure or disablement of the electrical valve 42, however, the pressure controlled valve 52A is active and moved towards its second position. The pump outlet pressure has reached the fail safe/pressure set point. In this second position, shown in FIG. 12, the electrical valve 42 is de-energized or disabled. Any gallery pressure supply P of lubricant to electrical valve 42 is stopped or limited at the port P1 since the valve is disabled. In addition, pressurized fluid from the outlet 40 is provided at such a pressure through supply channel 70A that the valve body 51A of valve 52A is pushed or moved to a position that closes fluid communication through the routing channel A2 from the electrical valve 42, by closing off the openings of routing channel A2 and feed channel A3 associated with the valve 52A. Instead, valve 52A controls pressure in the control chamber A via fluid communication from the outlet, through the supply channel 70, the openings in the valve 52A, and through the feed channel A3, thereby pressurizing the control chamber via flow from the outlet to the control chamber (PP→A3). Further, lubricant may be delivered from the electrical valve 42 to the lubricant sump or tank via fluid communication from port T and through the venting channel 72A.

As such, FIG. 12 illustrates an example of the pressure controlled valve being (selectively) moved to the second valve position via fluid communication through the supply channel 70A when the outlet pressure is at or above the threshold level and the electrical valve is disabled. As previously noted, the predetermined, set, or threshold amount of pressure for activating the valve 52A may be based on a customer's specifications, for example. In an embodiment, the valve opening pressure for valve 52A is approximately 7 bar.

Figure 13:
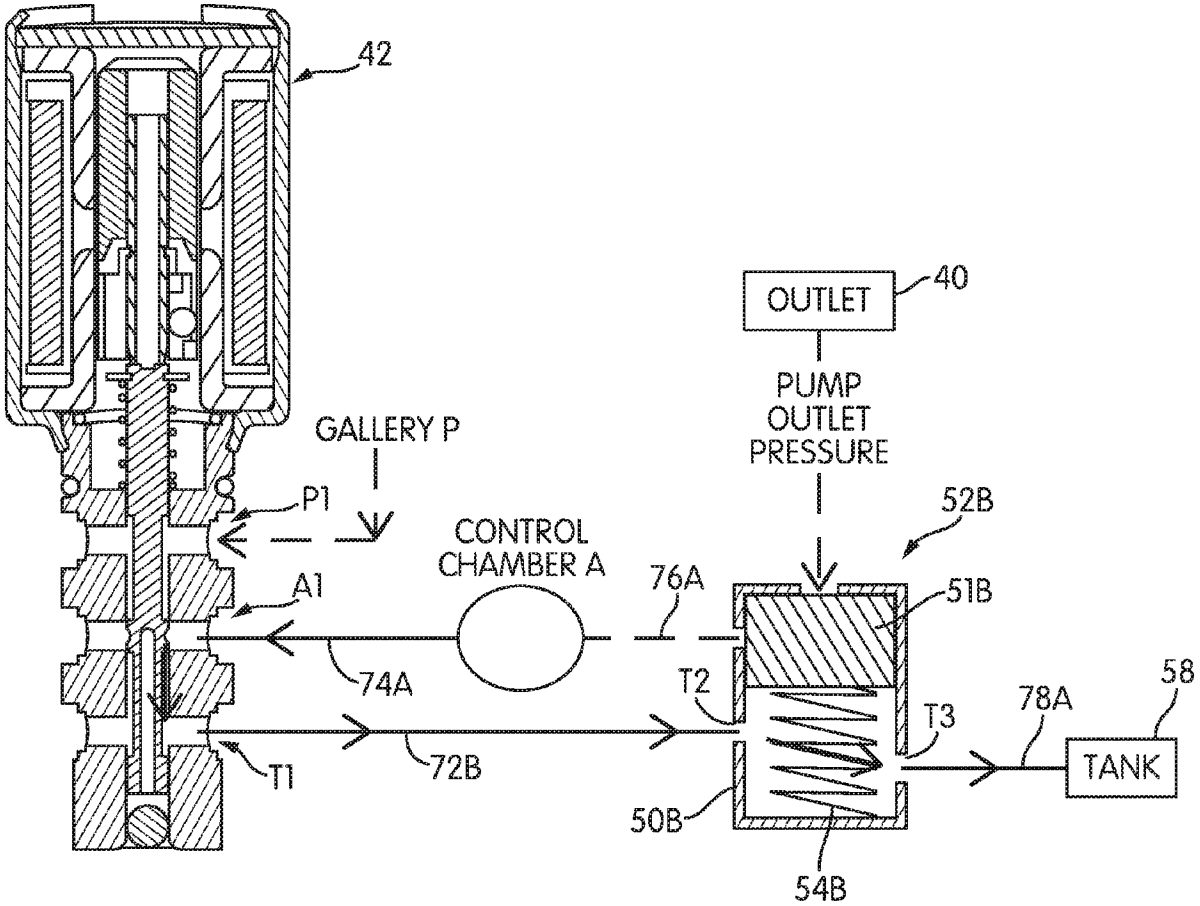
FIG. 13 is a schematic view of parts associated with a pump housing including a control chamber, an electrical valve with ports, channels, and a pressure controlled valve in accordance with yet another embodiment of this disclosure.
Figure 14:
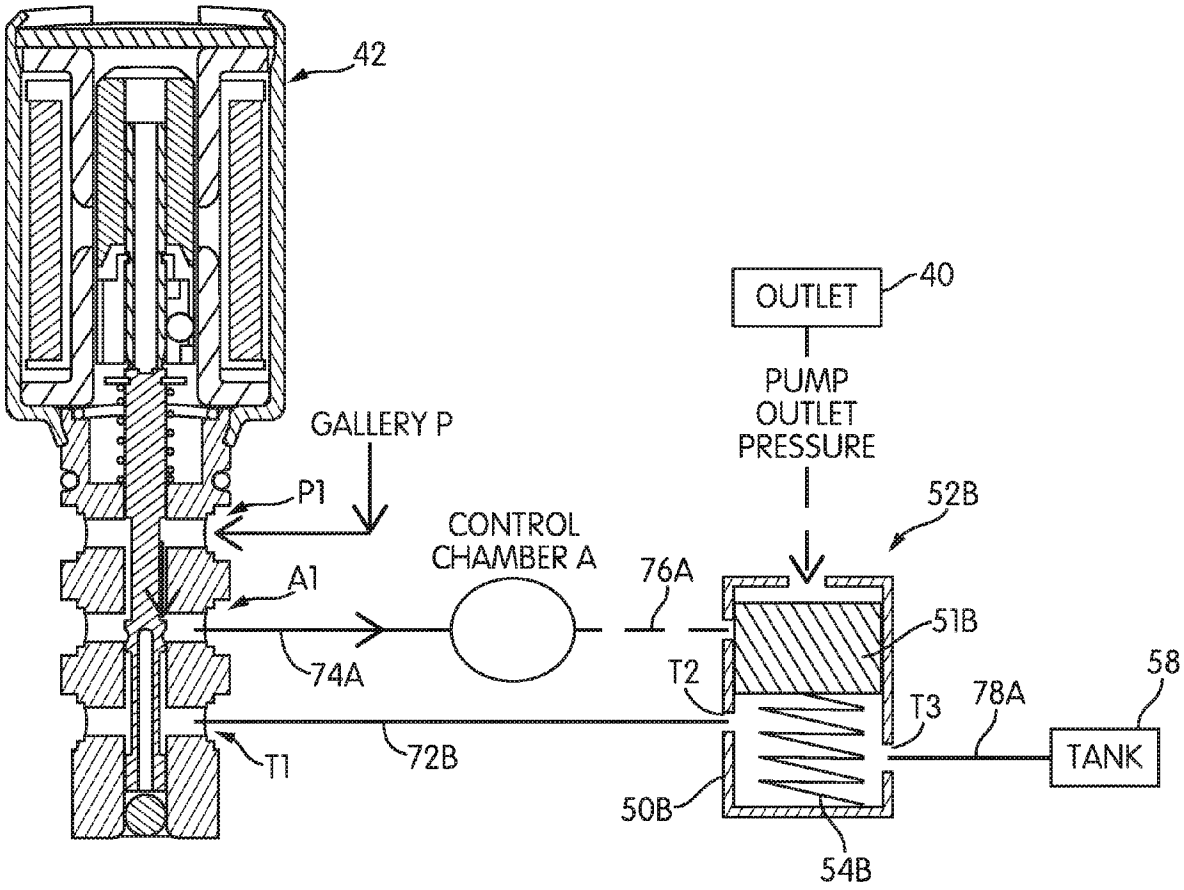
FIG. 14 shows a schematic diagram illustrating flow of lubricant and use of the parts of FIG. 13 when the pressure controlled valve is in a first valve position in the pump housing, in accordance with an embodiment.
Figure 15:
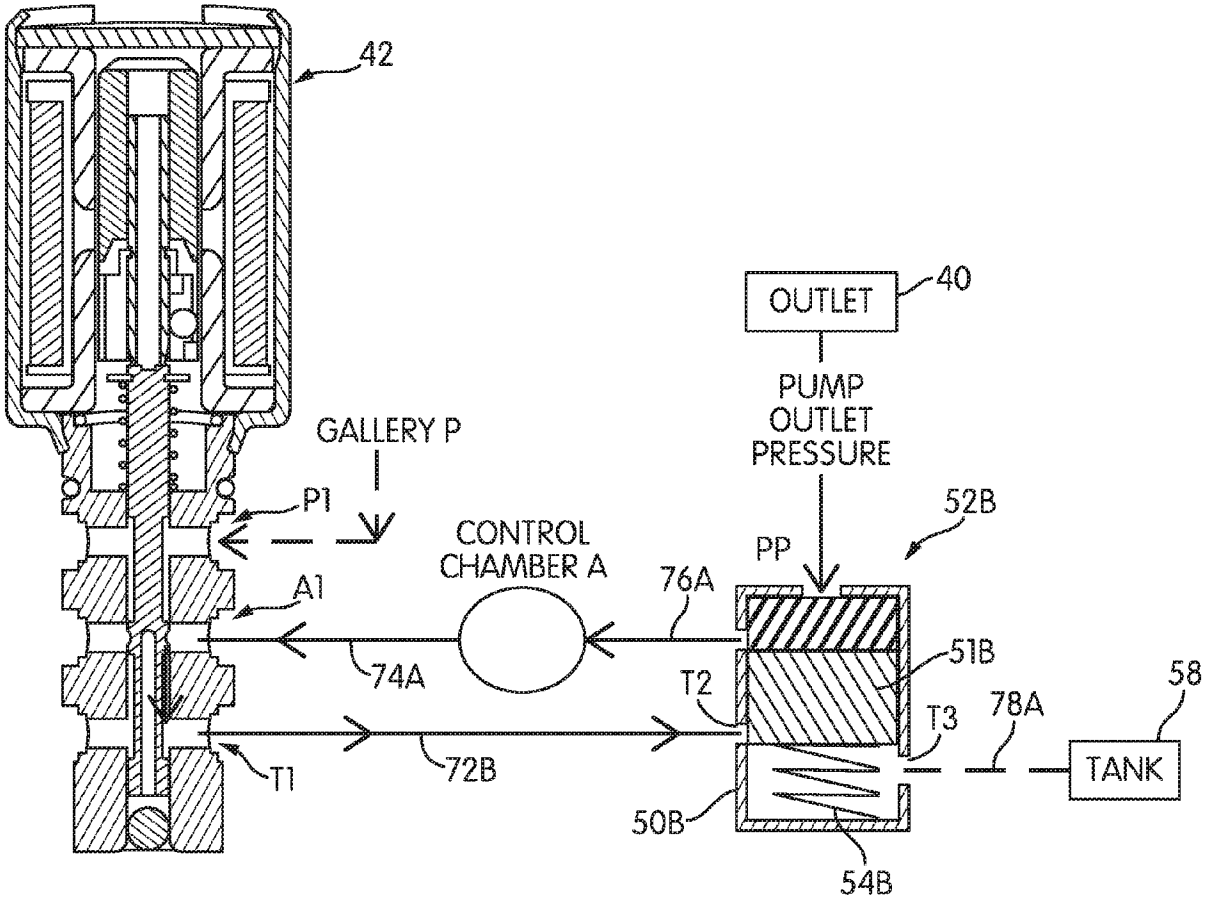
FIG. 15 shows a schematic diagram illustrating flow of lubricant and use of the parts of FIG. 13 when the pressure controlled valve is in a second valve position in the pump housing, in accordance with an embodiment.

FIGS. 13-15 are schematic views of parts associated with a pump housing in accordance with another embodiment. For simplicity purposes only, similar parts as described and noted above with respect to FIGS. 1-9 have been labeled with the same reference numbers in FIGS. 13-15. Accordingly, it should also be understood that the features previously noted above with respect to those parts similarly apply to each of the embodiments of FIGS. 13-15 and thus are not necessarily repeated here and below. The pump of FIGS.

13-15 includes a single control chamber A (between the housing and the control slide, both not shown), an electrical valve 42, a pressure controlled valve 52B, and a number of channels.

The electrical valve 42 includes a port P1 that is connected to the gallery P of the pump via an inlet channel or passage, as well as a port A1 and a port T1. Port A1 in the illustrative embodiment of FIG. 13 is configured for selective fluid communication with a valve channel 74A connecting the electrical valve 42 and the control chamber A. Port T1 is configured for selective fluid communication with a routing channel 72B connecting the electrical valve 42 and the pressure controlled valve 52B (much like the third and fourth channel in the earlier described embodiment). A venting channel 78A for venting the electrical valve 42 is also provided and connects to the pressure controlled valve 52B via an opening.

The pressure controlled valve 52B is provided in a valve housing SOB and is designed to control delivery of the lubricant or fluid via port T1 of the electrical valve 42 (further described below). That is, in an embodiment, the valve housing 50B may be machined into the pump housing (or cover) such that the housing 50B is formed integrally as part of the pump, and parts of the valve 52B (e.g., valve body 51B/piston and spring 54B) may be placed into the pump housing in the designated area. In another embodiment, the valve housing 50B may be designed to contain parts of the valve 52B, such that the housing 50B may be inserted into a designated area of the pump. Like the previously described valve 52, valve 52B is moveable between a first valve position and at least a second valve position within valve housing SOB based on an output pressure of the pressurized lubricant delivered through the outlet 40. The disclosed valve 52B can replace the prior-art panic valve, and may be a spool control valve, for example. In an embodiment, the disclosed pressure controlled valve 52B fits in the same space or valve housing as a known panic valve (such as valve 44). The pressure controlled valve 52B includes a valve body 51B (or piston) and a control spring 54B is provided in the valve housing 50B. As shown in FIG. 13, for example, the spring 54B biases the valve body 51B in an upward direction towards channel 70B connected to the outlet 40 of the pump. Based on the position of the valve body 51B within the valve housing 50B and its alignment with openings of channels in the pump housing, the valve receives and directs lubricant therethrough.

FIG. 13 also shows a feed channel 76A connecting the pressure controlled valve 52B and the control chamber A, and a supply channel 70B connecting the outlet and the pressure controlled valve 52B. In operation, the pressure controlled valve 52B is configured for selective movement into and between its first and at least second positions based on the pressure level through the outlet 40 and into valve 52B (via channel 70B), based on if the electrical valve 42 is properly operating.

During normal operation of the pump, as represented in FIG. 13, the electrical valve 42 may not be energized. The pump outlet pressure is below a fail safe/pressure set point, and thus the pump may run up to or at full displacement (maximum displacement) while below the set or threshold pressure. Any gallery pressure supply P of lubricant to electrical valve 42 is stopped or limited at the port P1 since the valve is not energized. Pressurized fluid is delivered from control chamber A, through valve channel 74A, and to the electrical valve 42 via port A1. The control spring 54A of pressure control valve 52A pushes the valve body 51A upwardly (e.g., towards or to a maximum stop position, or its first position), thus opening flow from the electrical valve 42 to the tank or sump (T2→T3). Pressurized fluid is directed from port A1 to port T of electrical valve 42, through routing channel 72B, to and through pressure controlled valve 52B, and vents through the venting channel 78A to the sump or tank. Accordingly, the control chamber A may be vented via delivery through A1→T1→T2→T3 during normal operation.

FIG. 14 illustrates an example of controlling the pump during normal operation using the A1 port of the electrical valve 42 when the electrical valve 42 is activated, i.e., the valve 42 is energized and the pump is a regulated displacement to control pressure in the pump (e.g., operating the pump in a regulation mode). In the illustrated configuration, the pressure controlled valve 52B is inactive, i.e., moved to or biased towards its first position. The pump outlet pressure is below a fail safe/pressure set point (or threshold pressure), and thus the pump may run below and up to a preset fail safe pressure by pressurizing the control chamber A via the electrical valve 42. The gallery pressure supply P of lubricant flows to the electrical valve from port P1 to port. A1. The control spring 54A of pressure control valve 52B pushes the valve body 51B upwardly, thus maintaining (or opening) flow from the electrical valve 42 to the lubricant sump via fluid communication through routing channel 72B to venting channel 78A (T2→T3), if venting is needed. However, in this mode, when the pressure controlled valve 52B is in its first position, flow is directed from the electrical valve 42 to the control chamber A. Specifically, pressurized fluid is delivered from gallery to port P1, and is communicated from port A1 through the valve channel 74A and to the control chamber A, to pressurize the control chamber A. Further, fluid communication through the feed channel 76A from the control chamber A to valve 52B is limited via valve body 51B. Accordingly, the control chamber A is pressure supplied from P1→A1→control chamber A during normal operation when the electrical valve 42 is activated/energized.

When the pump needs to be operated at regulated displacement in a fail safe mode due to failure or disablement of the electrical valve 42, however, the pressure controlled valve 52A is active and moved towards its second position. The pump outlet pressure has reached the fail safe/pressure set point. In this second position, shown in FIG. 15, the electrical valve 42 is de-energized or disabled. Any gallery pressure supply P of lubricant to electrical valve 42 is stopped or limited at the port P1 since the valve is disabled. In addition, pressurized fluid from the outlet 40 is provided at such a pressure through supply channel 70B that the valve body 51B of valve 52B is pushed or moved to a position that closes fluid communication from the venting channel 78A to the lubricant sump by closing off the opening and fluid communication from routing channel 72B associated with the electrical valve 42. Ports A1 and T1 of the electrical valve 42 are connected, but venting is limited. Instead, valve 52B controls pressure in the control chamber A via fluid communication from the outlet, through the supply channel 70, the openings in the valve 52B, and through the feed channel 76A to the control chamber A. Accordingly, the control chamber A is pressurized via flow from the outlet to the control chamber (PP→A) in fail safe mode.

As such, FIG. 15 illustrates an example of the pressure controlled valve being (selectively) moved to the second valve position via fluid communication through the supply channel 70B when the outlet pressure is at or above the threshold level and the electrical valve is disabled. As previously noted in the other embodiments, the predetermined, set, or threshold amount of pressure for activating the valve 52B may be based on a customer's specifications, for example. In an embodiment, the valve opening pressure for valve 52B is approximately 7 bar.

Moreover, it should be noted that any of the configurations of pressure controlled valves 52, 52A, 52B is optionally moveable between more than two positions, e.g., into and/or between a first valve position, a second valve position, and at least a third valve position, within valve housing 50, based on an output pressure of the pressurized lubricant delivered through the outlet 40. The pressure controlled valve may be inactive in the first valve position for the output pressure below a threshold level and is active near or in the second valve position and/or near or in a third valve position for an outlet pressure that is at or above a threshold level, for example. The valve may be activated to move towards or into the second valve position and/or third valve position and place the pump 100 in a fail safe mode to control the maximum pump pressure in case of electrical valve 42 failure. When the electrical valve 42 fails, the valve may take over and may be used to balance pressure forces of oil/lubricant pressure through channels in the pump housing, e.g., by limiting the pump pressure, e.g., over a speed range, in any number of positions. The valve may move further within the valve housing 50 (e.g., further down, with reference to the FIGS.) into its third position, and, optionally, further open up channel(s) within the housing and/or open up an additional and/or separate cross section of a channel or port (not shown) that is connected to the tank or sump, for example, so that the outlet pressure is (further) reduced.

Further, the disclosed pressure controlled valves 52, 52A, 52B may act as a panic valve during cold start conditions when the pump control via the electrical valve 42 is not quick enough to control the outlet pressure (e.g., below a defined maximum pressure target or threshold, e.g., such as 7 or 10 bar). For example, the valve may be moved to another (e.g., second) position where the outlet is vented through the channel 70, 70A, 70B directly to the lubricant sump, or to a position (e.g., third) position to vent through another channel or port (not shown) to the sump, and reduce the outlet pressure, until such venting is no longer needed for regular operation of the pump 100. Movement into a third position allows for control of pump and pressure when the pressure control in fail safe mode in a second position is not fast enough. Accordingly, the disclosed embodiments of the pressure controlled valves 52, 52A, 52B result in fuel savings at cold start (e.g., as compared to panic valve design), and a quick response of the pump during the cold start, since the fail safe mode is operated by/based on the pump outlet pressure.

The pressure controlled valve as disclosed herein may be implemented and applied to electrical valve controlled pumps, for example, and should not be limited to the disclosed exemplary design. Such pumps are typically single chamber pumps, but the use of the pressure controlled valve is not limited to such types.

Figure 16:
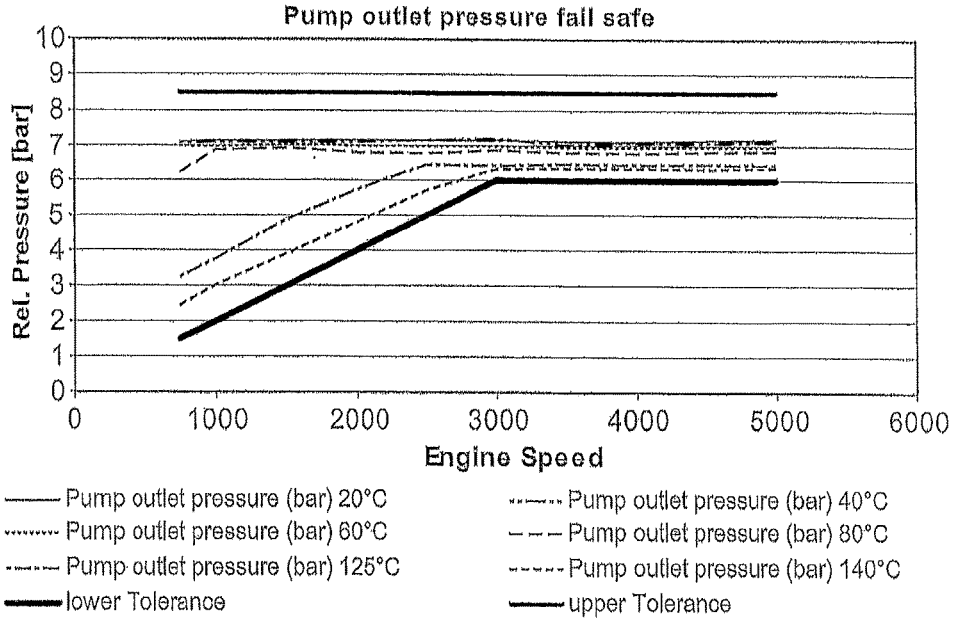
FIG. 16 is an exemplary plot of the pump outlet pressure when the fail safe function of the pressure controlled valve is implemented, as shown by measuring the relative pressure versus engine speed.
Figure 17:
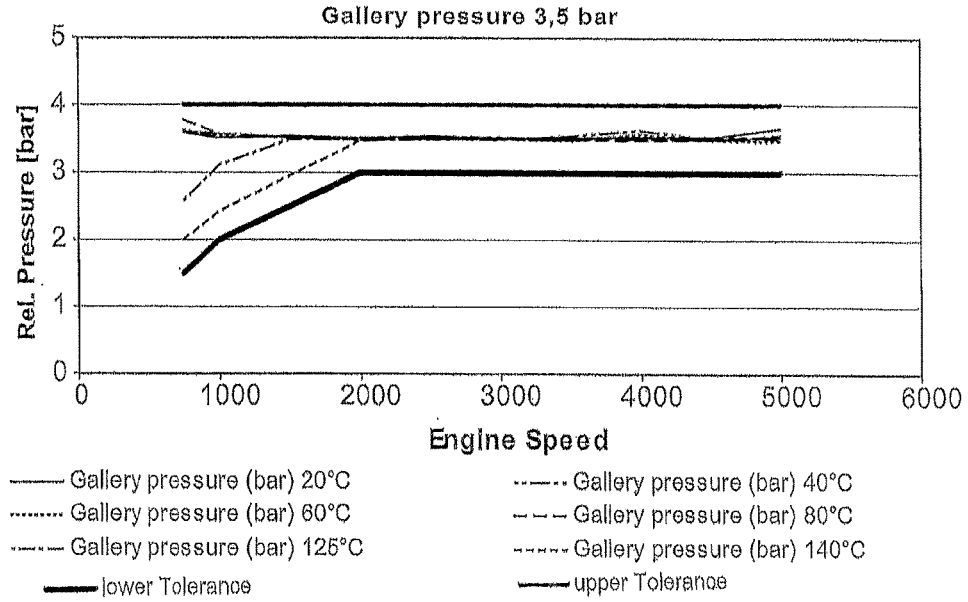
FIG. 17 is an exemplary plot of the gallery pressure when the fail safe function of the pressure controlled valve is implemented, as shown by measuring the relative pressure versus engine speed.

FIG. 16 is an exemplary plot of the pump outlet pressure when the fail safe function of the disclosed pressure controlled valve is implemented, as shown by measuring the relative pressure versus engine speed. As seen in the plot of FIG. 16, at lower engine speeds, e.g., less than 3000 rpm, the pump outlet pressure is increases. However, when the fail safe mode is in effect and the pressure controlled valve 52 is moved towards and/or in its second valve position in the pump 100, the relative pressure is maintained at a relatively steady pressure even as the engine speed increases to greater than 3000 rpm, between a lower tolerance and an upper tolerance. FIG. 17 is an exemplary plot of the gallery pressure when the fail safe function of the disclosed pressure controlled valve is disabled and the regulation mode is implemented, as shown by measuring the relative pressure versus engine speed. As seen in the plot of FIG. 17, the pump gallery pressure is relatively maintained between a lower tolerance and an upper tolerance despite the engine speed.

The disclosed embodiments provide examples for replacing a needed panic valve on gallery feed back controlled pumps, thus no panic valve is required, or fine tuning thereof.

Further, no preset fail safe pressure on the electrical valve is required when using any of the disclosed valves 52, 52A, or 52B. Any time the electrical valve fails and the pressure exceeds the threshold, the pressure controlled valve implements the fail safe function of at least pressurizing the control chamber via flow from the outlet to the control chamber.

The herein disclosed valve systems can be used at different pump applications as well.

Figure 18:
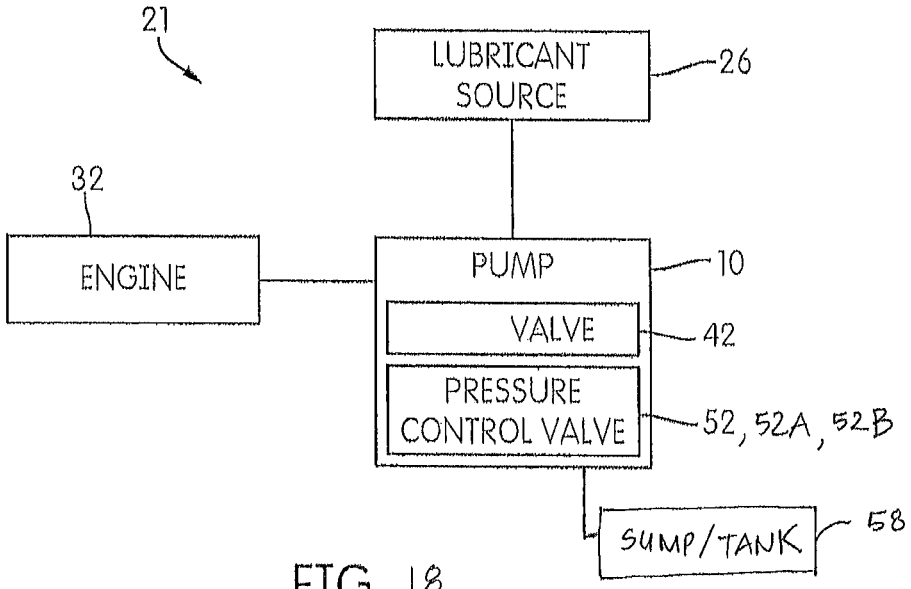
FIG. 18 is a schematic diagram of a system in accordance with an embodiment of the present disclosure.

Another aspect of this disclosure provides a system that includes: an engine; a lubricant source containing lubricant and a variable displacement vane pump connected to the lubricant source for dispensing lubricant to the engine. FIG. 18 is a schematic diagram of a system 21 in accordance with an embodiment of the present disclosure. The system 21 can be a vehicle or part of a vehicle, for example. The system 21 includes a mechanical system such as an engine 32 (e.g., internal combustion engine) for receiving pressurized lubricant from the pump 100, and a sump or tank 58. The pump 100 receives lubricant (e.g., oil) from a lubricant source 26 (input via inlet 30) and pressurizes and delivers it to the engine 32 (output via outlet 40). The pump 100 includes an electrical valve 42 and a pressure controlled valve that work in an alternating fashion. The pressure controlled valve in the pump 100 and associated with the system may be a valve 52, 52A, or 52B as described in detail above with reference to the illustrative embodiments. The pressure controlled valve is configured for selective movement to its second valve position when the outlet pressure is at or above the threshold level and the electrical valve is disabled.

Also, the depictions of the parts of the pump 100 as shown in FIGS. 2 and 3, for example, are not intended to be limiting. For example, the control ring or control slide 12 as shown in FIG. 2 includes a D-ring portion 17 that provides an additional outlet connection 43 to outlet 40 for lubricant to flow through (from the internal chamber). However, use of such a D-ring portion 17 is not intended be limiting, and may not be provided at all. Further, an additional outlet connection 43 or opening need not be provided in the pump 100.

While the principles of the disclosure have been made clear in the illustrative embodiments set forth above, it will be apparent to those skilled in the art that various modifications may be made to the structure, arrangement, proportion, elements, materials, and components used in the practice of the disclosure.

It will thus be seen that the features of this disclosure have been fully and effectively accomplished. It will be realized, however, that the foregoing preferred specific embodiments have been shown and described for the purpose of illustrating the functional and structural principles of this disclosure and are subject to change without departure from such principles. Therefore, this disclosure includes all modifications encompassed within the spirit and scope of the following claims.

What is claimed is:

1. A variable displacement vane pump for dispensing lubricant to a system, the pump being configured for connection to a lubricant sump for holding lubricant, the pump comprising:

a housing;

an inlet for inputting lubricant into the housing;

an outlet for delivering pressurized lubricant to the system from the housing;

a control slide displaceable within the housing between a first slide position for producing maximum pump displacement and a second slide position for producing a reduced pump displacement to adjust displacement of the pump through the outlet, the second slide position being different than the first slide position;

a control chamber, between the housing and the control slide, for receiving pressurized lubricant to move the control slide towards the second slide position;

an electrical valve fluidly connected to the control chamber to control pressure therein;

a pressure controlled valve moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level;

a routing channel connecting the electrical valve and the pressure controlled valve;

a feed channel connecting the pressure controlled valve and the control chamber;

a venting channel for venting the electrical valve to the lubricant sump;

a supply channel connecting the pressure controlled valve and the outlet;

wherein, in its first valve position, the pressure controlled valve is inactive and (a) allows fluid communication between the electrical valve and the routing channel, and (b) allows fluid communication between the feed channel and the routing channel to either pressurize or vent the control chamber;

wherein, in its second valve position, the pressure controlled valve is active and (a) controls pressure in the control chamber via fluid communication from the outlet, through the supply channel and through the feed channel to the control chamber, and (b) closes fluid communication between the routing channel and the control chamber, thereby pressurizing the control chamber via flow from the outlet to the control chamber; and wherein the pressure controlled valve is configured for selective movement to the second valve position via fluid communication through the supply channel when the outlet pressure is at or above the threshold level and the electrical valve is disabled.

2. The pump according to claim 1, wherein the electrical valve is a pulse width modulation valve wherein the pulse with modulation valve controls the pressure in the control chamber when the pressure controlled valve is in its first valve position.

3. The pump according to claim 2, wherein the pulse width modulation valve is disabled from controlling the pressure in the control chamber when the pressure controlled valve in its second valve position.

4. The pump according to claim 1, wherein the pressure controlled valve comprises a body and wherein a portion of the body comprises a reduced diameter relative to at least a lower part of the body, and wherein, in the second valve position, the reduced diameter portion is configured to be positioned adjacent to the feed channel to regulate flow from the supply channel into the control chamber.

5. The pump according to claim 1, wherein the system is an engine.

6. The pump according to claim 1, wherein the pressure controlled valve is further moveable to a third valve position based on the output pressure of the pressurized lubricant delivered through the outlet, the pressure controlled valve being in the third valve position for the outlet pressure that is above the threshold level.

7. A variable displacement vane pump for dispensing lubricant to a system, the pump being configured for connection to a lubricant sump for holding lubricant, the pump comprising:

a housing;

an inlet for inputting lubricant into the housing;

an outlet for delivering pressurized lubricant to the system from the housing;

a control slide displaceable within the housing between a first slide position for producing maximum pump displacement and a second slide position for producing a reduced pump displacement to adjust displacement of the pump through the outlet, the second slide position being different than the first slide position;

a control chamber, between the housing and the control slide, for receiving pressurized lubricant to move the control slide towards the second slide position;

an electrical valve fluidly connected to the control chamber to control pressure therein;

a valve channel connecting the control chamber and the electrical valve;

a pressure controlled valve moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level;

a routing channel connecting the electrical valve and the pressure controlled valve;

a feed channel connecting the pressure controlled valve and the control chamber;

a venting channel for venting the electrical valve to the lubricant sump;

a supply channel connecting the pressure controlled valve and the outlet;

wherein, in its first valve position, the pressure controlled valve is inactive and (a) closes fluid communication through the feed channel, and (b) communicates the electrical valve to the lubricant sump via the routing channel and the venting channel, thereby allowing the electrical valve to pressurize the control chamber by delivering lubricant through the valve channel to pressurize the control chamber or to vent the control chamber via the routing channel and the venting channel;

wherein, in its second valve position, the pressure controlled valve is active and (a) controls pressure in the control chamber via fluid communication from the outlet, through the supply channel and through the feed channel to the control chamber, and (b) closes fluid communication between the venting channel to the lubricant sump, thereby pressurizing the control chamber via flow from the outlet to the control chamber;

wherein the pressure controlled valve is configured for selective movement to the second valve position via fluid communication through the supply channel when the outlet pressure is at or above the threshold level and the electrical valve is disabled.

8. The pump according to claim 7, wherein the electrical valve is a pulse width modulation valve wherein the pulse with modulation valve controls the pressure in the control chamber when the pressure controlled valve is in its first valve position.

9. The pump according to claim 8, wherein the pulse width modulation valve is disabled from controlling the pressure in the control chamber when the pressure controlled valve in its second valve position.

10. The pump according to claim 7, wherein the system is an engine.

11. The pump according to claim 7, wherein the pressure controlled valve is further moveable to a third valve position based on the output pressure of the pressurized lubricant delivered through the outlet, the pressure controlled valve being in the third valve position for the outlet pressure that is above the threshold level.

12. A variable displacement vane pump for dispensing lubricant to a system, the pump being configured for connection to a lubricant sump for holding lubricant, the pump comprising:

a housing;

an inlet for inputting lubricant into the housing;

an outlet for delivering pressurized lubricant to the system from the housing;

a control slide displaceable within the housing between a first slide position for producing maximum pump displacement and a second slide position for producing a reduced pump displacement to adjust displacement of the pump through the outlet, the second slide position being different than the first slide position;

a control chamber between the housing and the control slide for receiving pressurized lubricant to move the control slide towards the second slide position;

an electrical valve fluidly connected to the control chamber to control pressure therein;

a valve channel connecting the control chamber and the electrical valve;

a pressure controlled valve moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level;

a feed channel connecting the pressure controlled valve and the control chamber;

a venting channel for venting the electrical valve to the lubricant sump;

a supply channel connecting the pressure controlled valve and the outlet;

wherein, in its first valve position, the pressure controlled valve is inactive and (a) closes fluid communication through the feed channel to the control chamber, and (b) opens fluid communication between the electrical valve and the lubricant sump via the venting channel thereby allowing the electrical valve to pressurize the control chamber through the valve channel or to vent the control chamber via the venting channel;

wherein, in its second valve position, the pressure controlled valve is active and (d) controls pressure in the control chamber via fluid communication from the outlet, through the supply channel and through the feed channel to the control chamber, and (e) closes fluid communication of the venting channel to the lubricant sump, thereby pressurizing the control chamber via flow from the outlet to the control chamber; and wherein the pressure controlled valve is configured for selective movement to the second valve position via fluid communication through the supply channel when the outlet pressure is at or above the threshold level and the electrical valve is disabled.

13. The pump according to claim 12, wherein the electrical valve is a pulse width modulation valve wherein the pulse with modulation valve controls the pressure in the control chamber when the pressure controlled valve is in its first valve position.

14. The pump according to claim 13, wherein the pulse width modulation valve is disabled from controlling the pressure in the control chamber when the pressure controlled valve in its second valve position.

15. The pump according to claim 12, wherein the pressure controlled valve comprises a body and wherein a portion of the body comprises a reduced diameter relative to at least a lower part of the body, and wherein, in the second valve position, the reduced diameter portion is configured to be positioned adjacent to the feed channel to regulate flow from the supply channel into the control chamber.

16. The pump according to claim 12, wherein the system is an engine.

17. The pump according to claim 12, wherein the pressure controlled valve is further moveable to a third valve position based on the output pressure of the pressurized lubricant delivered through the outlet, the pressure controlled valve being in the third valve position for the outlet pressure that is above the threshold level.

18. The pump according to claim 12, further comprising a passage connected to the venting channel, wherein, in the first valve position, delivery of lubricant from the electrical valve to the lubricant sump travels through the passage and the venting channel.

19. The pump according to claim 12, further comprising:

a resilient structure biasing the control slide towards the first slide position;

a rotor with at least one vane mounted in the housing and configured for rotation within and relative to the control slide, the at least one vane configured for engagement with an inside surface of the control slide during rotation thereof.

20. A system comprising:

an engine;

a lubricant sump containing lubricant;

a variable displacement vane pump for dispensing lubricant to the engine, the pump comprising:

a housing;

an inlet for inputting lubricant into the housing;

an outlet for delivering pressurized lubricant to the system from the housing;

a control slide displaceable within the housing between a first slide position for producing maximum pump displacement and a second slide position for producing a reduced pump displacement to adjust displacement of the pump through the outlet, the second slide position being different than the first slide position;

a control chamber between the housing and the control slide for receiving pressurized lubricant to move the control slide towards the second slide position;

an electrical valve fluidly connected to the control chamber to control pressure therein;

a valve channel connecting the control chamber and the electrical valve;

a pressure controlled valve moveable between a first valve position and a second valve position based on an output pressure of the pressurized lubricant delivered through the outlet, the pressure controlled valve being in the first valve position for the output pressure below a threshold level and in the second valve position for the outlet pressure that is at or above the threshold level;

a feed channel connecting the pressure controlled valve and the control chamber;

a venting channel for venting the electrical valve to the lubricant sump;

a supply channel connecting the pressure controlled valve and the outlet;

wherein, in its first valve position, the pressure controlled valve is inactive and (a) closes fluid communication through the feed channel to the control chamber, and (b) opens fluid communication between the electrical valve and the lubricant sump via the venting channel thereby allowing the electrical valve to pressurize the control chamber through the valve channel or to vent the control chamber via the venting channel;

wherein, in its second valve position, the pressure controlled valve is active and (d) controls pressure in the control chamber via fluid communication from the outlet, through the supply channel and through the feed channel to the control chamber, and (e) closes fluid communication of the venting channel to the lubricant sump, thereby pressurizing the control chamber via flow from the outlet to the control chamber; and wherein the pressure controlled valve is configured for selective movement to the second valve position via fluid communication through the supply channel when the outlet pressure is at or above the threshold level and the electrical valve is disabled.

21. The system according to claim 20, further comprising a routing channel connecting the electrical valve and the pressure controlled valve;

wherein, in its first valve position, the pressure controlled valve opens fluid communication between the electrical valve and the lubricant sump via the routing channel and the venting channel thereby allowing the electrical valve to pressurize the control chamber through the valve channel, thereby allowing the electrical valve to pressurize the control chamber by delivering lubricant through the valve channel to pressurize the control chamber or to vent the control chamber via the routing channel and the venting channel.

22. The system according to claim 20, further comprising a channel connected to the vent channel and the pressure controlled valve and configured for selective communication with the lubricant sump;

wherein, in its first valve position, the pressure controlled valve opens fluid communication between the electrical valve and the lubricant sump via the venting channel by opening the channel connected to the vent channel and the pressure control valve for communication to the lubricant sump thereby allowing the electrical valve to pressurize the control chamber by delivering fluid in through the valve channel and vent the control chamber via the vent channel and the channel connected to the vent channel and the pressure control valve;

wherein, in its second valve position, the pressure controlled valve closes fluid communication through the channel connected to the vent channel and pressure controlled valve to the lubricant sump.

23. The system according to claim 20, wherein the electrical valve is a pulse width modulation valve wherein the pulse with modulation valve controls the pressure in the control chamber when the pressure controlled valve is in its first valve position.

24. The system according to claim 23, wherein the pulse width modulation valve is disabled from controlling the pressure in the control chamber when the pressure controlled valve in its second valve position.

25. The system according to claim 20, wherein the pressure controlled valve comprises a body and wherein a portion of the body comprises a reduced diameter relative to at least a lower part of the body, and wherein, in the second valve position, the reduced diameter portion is configured to be positioned adjacent to the feed channel to regulate flow from the supply channel into the control chamber.

26. The system according to claim 20, wherein the pressure controlled valve is further moveable to a third valve position based on the output pressure of the pressurized lubricant delivered through the outlet, the pressure controlled valve being in the third valve position for the outlet pressure that is above the threshold level.

27. The system according to claim 20, wherein the pump further comprises a passage connected to the venting channel, wherein, in the first valve position, delivery of lubricant from the electrical valve to the lubricant sump travels through the passage and the venting channel.

28. The system according to claim 20, further comprising:

a resilient structure biasing the control slide towards the first slide position;

a rotor with at least one vane mounted in the housing and configured for rotation within and relative to the control slide, the at least one vane configured for engagement with an inside surface of the control slide during rotation thereof.

* * * * *